US008194910B2

(12) United States Patent
Uchida et al.

(10) Patent No.: US 8,194,910 B2
(45) Date of Patent: Jun. 5, 2012

(54) HEADPHONES

(75) Inventors: Hiroshi Uchida, Yokohama (JP); Makoto Ito, Yokohama (JP)

(73) Assignee: Victor Company of Japan, Ltd., Kanagawa-Ken (JP)

( * ) Notice: Subject to any disclaimer, the term of this patent is extended or adjusted under 35 U.S.C. 154(b) by 489 days.

(21) Appl. No.: 12/454,885

(22) Filed: May 26, 2009

(65) Prior Publication Data

US 2009/0296975 A1 Dec. 3, 2009

(30) Foreign Application Priority Data

May 30, 2008 (JP) ..... 2008-142430
May 30, 2008 (JP) ..... 2008-142435

(51) Int. Cl.
*H04R 25/00* (2006.01)

(52) U.S. Cl. ..... 381/370

(58) Field of Classification Search ..... 381/370, 381/374, 380
See application file for complete search history.

(56) References Cited

U.S. PATENT DOCUMENTS 4,965,838 A * 10/1990 Kamon et al. ..... 381/380
5,048,092 A * 9/1991 Yamagishi et al. ..... 381/380
2007/0081688 A1 * 4/2007 Chen ..... 381/370

FOREIGN PATENT DOCUMENTS

JP 11-225387 8/1999

* cited by examiner

*Primary Examiner* — Jeremy Luks
(74) *Attorney, Agent, or Firm* — Renner, Kenner, Greive, Bobak, Taylor & Weber

(57) ABSTRACT

A headphone set has a housing to contain a speaker unit, with a sound emitting surface through which sounds given off by the speaker unit are emitted out, and an ear pad attached to the housing to surround the sound emitting surface. The ear pad has a protruding member and an arc-like member sticking out in opposite directions. The degree of sticking out for the arc-like member is smaller than the degree of sticking out for the protruding member. The protruding member has an inner space interposed between a top section and an opposing bottom section closer than the top section to the sound emitting section. The arc-like member has a top section and an opposing bottom section closer than the top section to the sound emitting surface. The top section of the protruding member is positioned farther than that of the arc-like member from the sound emitting surface.

7 Claims, 18 Drawing Sheets

HEADPHONES

CROSS-REFERENCE TO RELATED APPLICATIONS

This application is based on and claims the benefit of priority from the prior Japanese Patent Application Nos. 2008-142430 filed on May 30, 2008, and 2008-142435 filed on May 30, 2008, the entire contents of which is incorporated herein by reference.

BACKGROUND OF THE INVENTION

The present invention relates to headphones, fitting in the auricles of user's ears comfortably but hardly detached from the auricles.

The widespread of portable music players has brought rapid expansion of the market of headphones that are to be connected to the players.

There is a type of popular headphones, fitting in the auricles of user's ears (usually, referred to as an inner-ear type), which is light and portable.

Such headphones are roughly classified into: a type equipped with a cylindrical sound emitter provided as protruding from a headphone body and an ear piece attached to the sound emitter, the ear piece inserted into each external auditory canal of user's ears; and another type with a headphone body fit in each auricle of user's ears to emit sounds, with no components to be inserted into each external auditory canal.

The former type is referred to as a canal type, distinguished from the latter type.

Discussed below is the latter type, not the canal type, among the inner-ear type headphones.

The latter type headphones usually consist of: a pair of speaker units for converting electrical signals into sounds; a body having a housing with an external shape suitably fit in each auricle of user's ears, in which each speaker unit is installed; and a cord extended from the body to supply audio signals from an external device to the speaker units.

The latter type includes headphones equipped with elastic ear pads each having an inner space and provided at a section of a housing that touches the auricle of a user' ear, for protection of sound leakage and higher comfortableness when fit in the auricle.

Such latter type headphones, not the canal type, have to be held in the auricles of user's ears only with a housing with no such ear pieces to be inserted into the external auditory canals of the user's ears. However, how the latter type headphones, not the canal type, are comfortably and firmly fit in the auricles of the user's ears depends on his or her auricles' shape and size.

The latter type headphones equipped with elastic ear pads described above may be relatively comfortably fit in the auricles of user's ears. However, this type is still easily detached from the auricles when an external force to detach it is applied due to no means of engaging with the auricles.

SUMMARY OF THE INVENTION

A purpose of the present invention is to provide a headphone set that can be comfortably and firmly fit in the auricles of user's ears.

The present invention provides a headphone set comprising at least one speaker section, the speaker section including: a speaker unit; a housing to contain the speaker unit, the housing having a sound emitting surface through which sounds given off by the speaker unit are emitted out; and a circular member provided on an outer surface of the housing so that the sound emitting surface is surrounded by the circular member, the circular member being made of a material that is more flexible than a material of which the housing is made, wherein the circular member includes: a protruding member that sticks out outwardly in a first radial direction of the circular member, the protruding member having a first top section, an opposing first bottom section, and an inner space interposed between the first top and bottom sections, the first top section being positioned farther than the first bottom section from the sound emitting surface; and an arc-like member that sticks out outwardly in a second radial direction of the circular member, the first and second radial directions being opposite to each other, a degree of sticking out for the arc-like member being smaller than a degree of sticking out for the protruding member, the arc-like member having a second top section and an opposing second bottom section in which the second top section is positioned farther than the second bottom section from the sound emitting surface, wherein the first top section of the protruding member is positioned farther than the second top section of the arc-like member from the sound emitting surface.

Moreover, the present invention provides a headphone set comprising at least one speaker section, the speaker section including: a speaker unit; a housing to contain the speaker unit, the housing having a sound emitting surface through which sounds given off by the speaker unit are emitted out; and a circular member provided on an outer surface of the housing so that the sound emitting surface is surrounded by the circular member, wherein the housing has a circular concave section formed on the outer surface of the housing, and the circular member includes: a protruding member that sticks out outwardly in a first radial direction of the circular member, the protruding member having a first top section, an opposing first bottom section, and an inner space interposed between the first top and bottom sections, the first bottom section being positioned closer than the first top section to the sound emitting surface; an arc-like member that sticks out outwardly in a second radial direction of the circular member, the first and second radial directions being opposite to each other, a degree of sticking out for the arc-like member being smaller than a degree of sticking out for the protruding member, the arc-like member having a second top section and an opposing second bottom section positioned closer than the second top section to the sound emitting surface; a first opening and an opposing second opening positioned closer than the first opening to the sound emitting surface, wherein the protruding and arc-like members are provided so that the first and second openings are interposed between the protruding and arc-like members, the housing being exposed to an outside of the housing through the first opening, the sound emitting surface being exposed to the outside through the second opening; and a circumferential protruding section provided at a circumference of the second opening, the circumferential protruding section sticking out from the circumference towards a center of the second opening, the circumferential protruding section being engaged with the circular concave section at a first engaging length in the protruding member side and a second engaging length in the arc-like member side, the first engaging length being longer than the second engaging length.

DETAILED DESCRIPTION OF PREFERRED EMBODIMENT

A preferred embodiment of headphones according to the present invention will be described with reference to FIGS. 1 to 19.

The same or analogous elements or components are given the same reference signs or numerals and the explanation thereof is omitted if not necessary.

Figure 1:
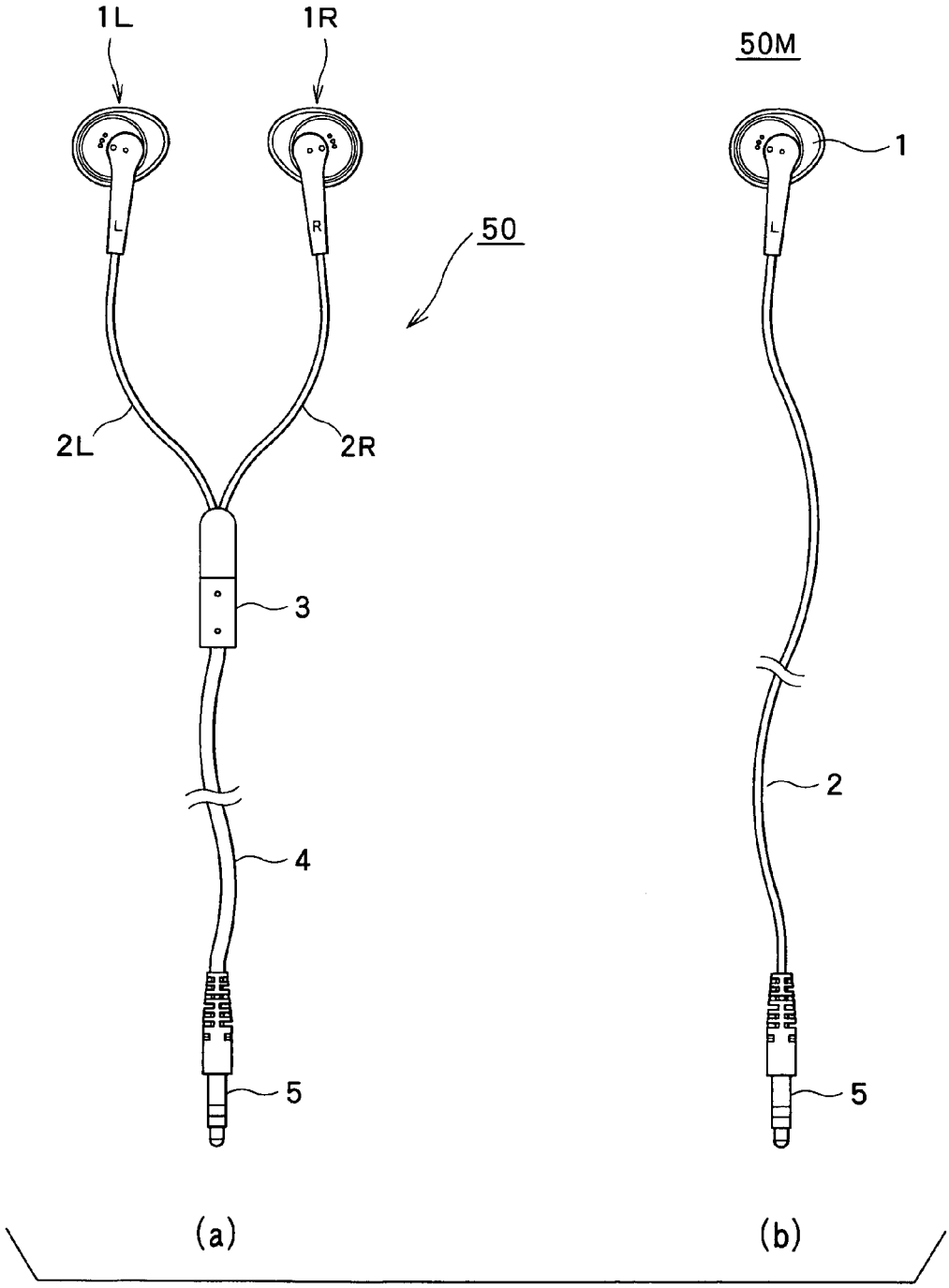
FIG. 1 shows appearances of stereo- and monaural-type headphone sets in (a) and (b), respectively, as preferred embodiments according to the present invention.

Illustrated in (a) of FIG. 1 is the appearance of a headphone set 50, a preferred embodiment according to the present invention.

The headphone set 50 is equipped with: a left-ear speaker section 1L; a right-ear speaker section 1R; cords 2L and 2R extended from the speaker sections 1L and 1R, respectively; a coupler 3 to couple the cords 2L and 2R; a plug 5 to be connected to an external player (not shown); and a main cord 4 that connects the coupler 3 and the plug 5.

When the plug 5 is connected to the external player, L- and R-channel audio signals are sent to the left- and right-ear speaker sections 1L and 1R, respectively, through the main cord 4, the coupler 3 and the cords 2L and 2R, and given off from the speaker sections 1L and 1R as sounds.

The present invention is not limited a stereo type such as shown in (a) of FIG. 1, but also applicable to a monaural type such as shown in (b) of FIG. 1.

A headphone set 50M shown in (b) of FIG. 1 is equipped with: a speaker section 1; a cord 2 extended from the speaker section 1; and a plug 5 to be connected to an external player (not shown).

Moreover, the present invention is applicable to a wireless-type headphone set (not shown) not equipped with a cord, a plug, etc., but with a wireless communication means to receive audio signals.

The left- and right-ear speaker sections 1L and 1R shown in (a) of FIG. 1 have the symmetrically identical structure. Thus, the left-ear speaker section 1L will only be described with reference to FIGS. 2 to 8.

Figure 2:
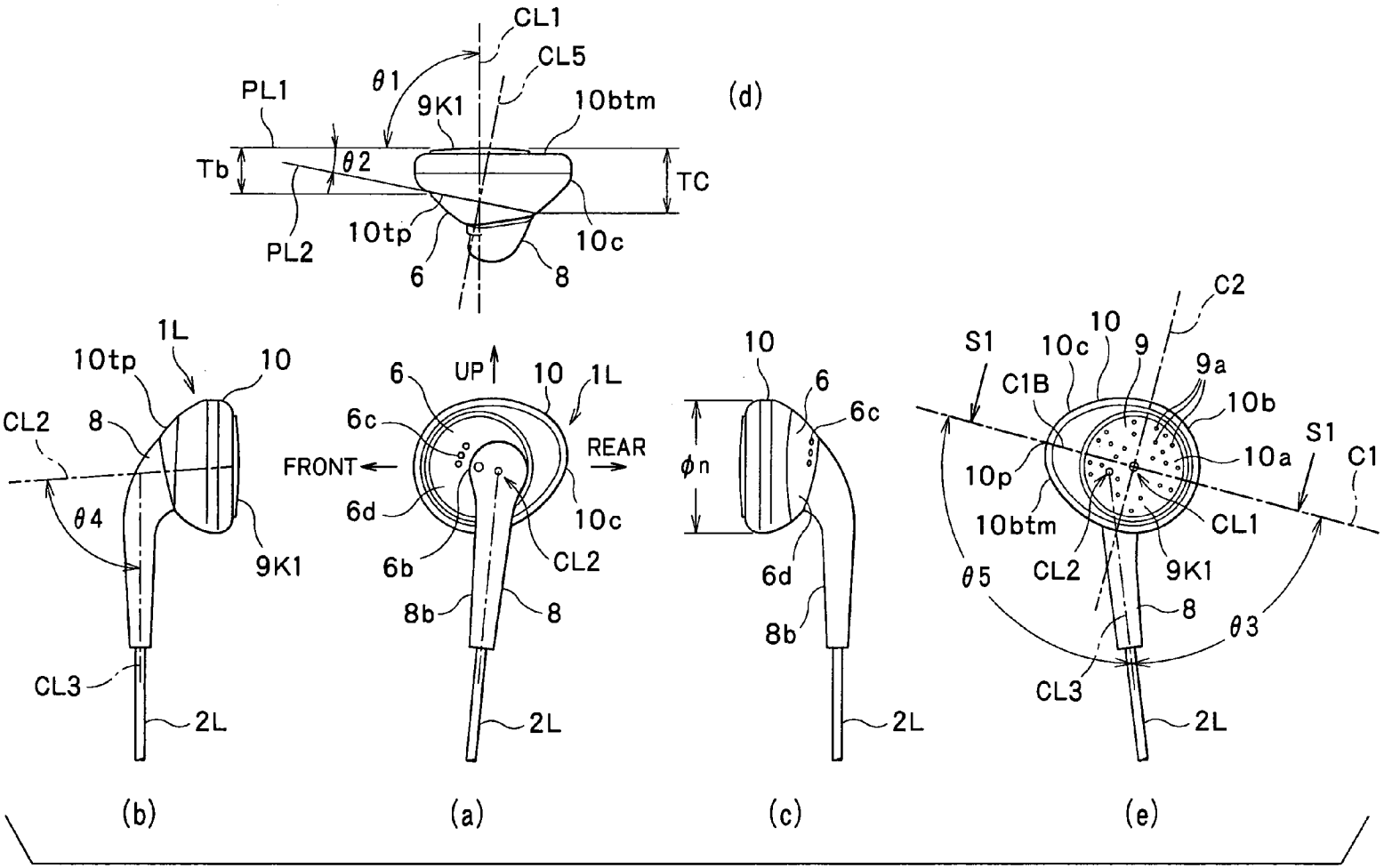
FIG. 2 shows several aspects of a speaker section in (a) to (e) for a headphone set according to the present invention.

In FIG. 2: (a) is a front view of the left-ear speaker section 1L which is illustrated as its left, right, and upper sides correspond to the front head, rear head and vertex sides of a user when the user attaches the speaker section 1L to his or her left ear; (b) is a left side view of the speaker section 1L; (c) is a right side view of the speaker section 1L; (d) is a top view of the speaker section 1L; and (e) is a rear view of the speaker section 1L.

Figure 3:
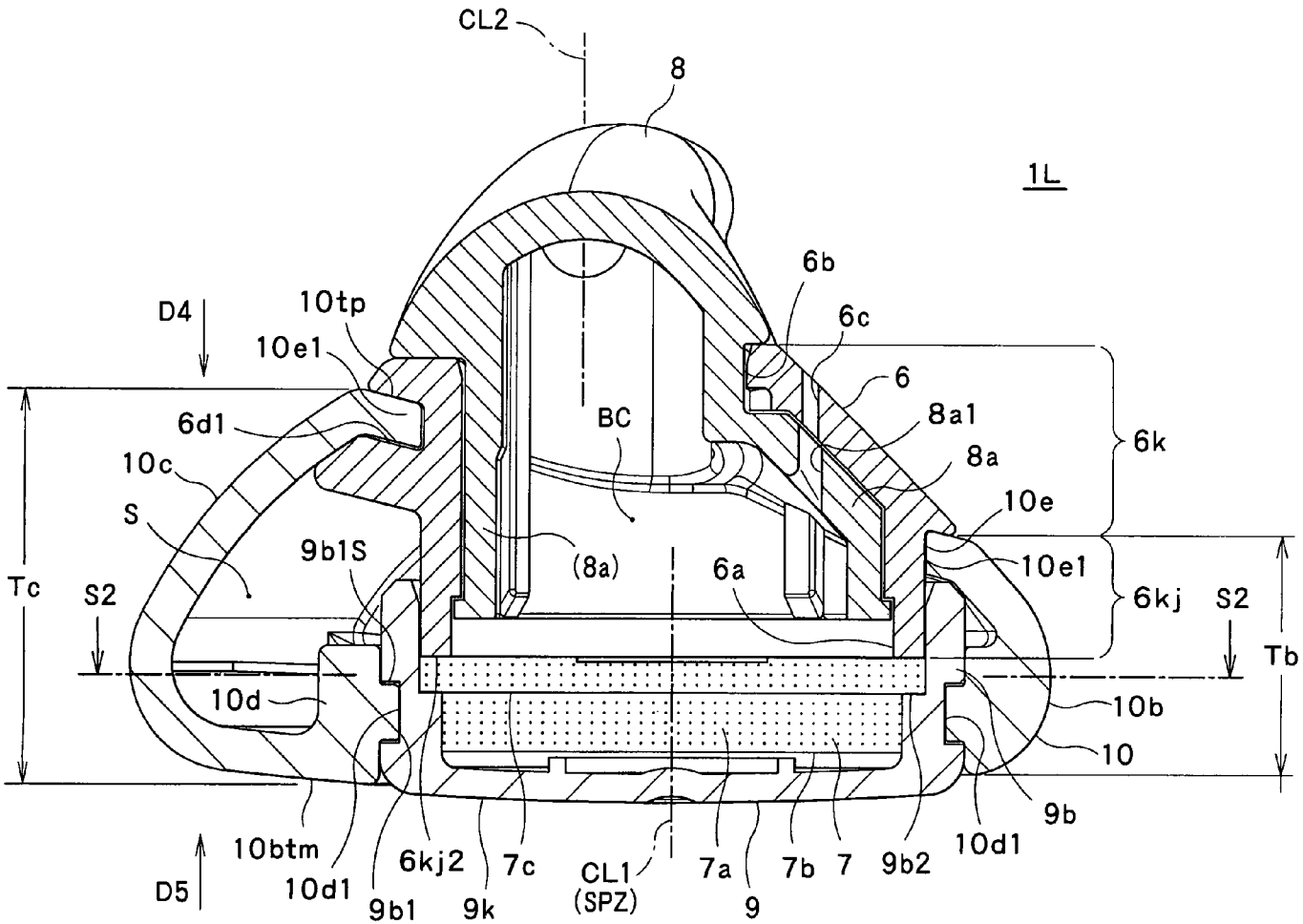
FIG. 3 shows a sectional view of the speaker section, taken on line S1-S1 of (e) of FIG. 2.

In FIG. 3 that is a sectional view of the left-ear speaker section 1L, taken on line S1-S1 of (e) of FIG. 2, the speaker section 1L consists of: a housing 6 (a right-up hatched section in FIG. 3) formed as having a truncated-cone-like hollow base 6*k* and a ring member 6*kj* provided at the larger diameter side of the base 6*k*; a flat cylindrical speaker unit 7 (a dotted section in FIG. 3, but not shown in FIG. 2) for converting electrical signals into sounds, fixed as stuffing a circular-like opening 6*a* of the ring member 6*kj* of the housing 6; a bushing 8 (a left-up hatched section in FIG. 3) attached to a circular-like opening 6*b* of the housing 6 at the smaller diameter side; a unit cover 9 attached to the housing 6 to cover the speaker unit 7; and a flexible ear pad 10 (a circular member) attached to the housing 6 at the outer periphery thereof.

Although not shown in FIG. 3, the cord 2L shown in (a) of FIG. 2 is extended from the housing 6 to the outside, that is an electrical wire with a protective covering, connected to the speaker unit 7, to send audio signals from an external player to the speaker unit 7.

The components or elements that constitute the left-ear speaker section 1L shown in FIG. 3 will be described in detail.

Figure 4:
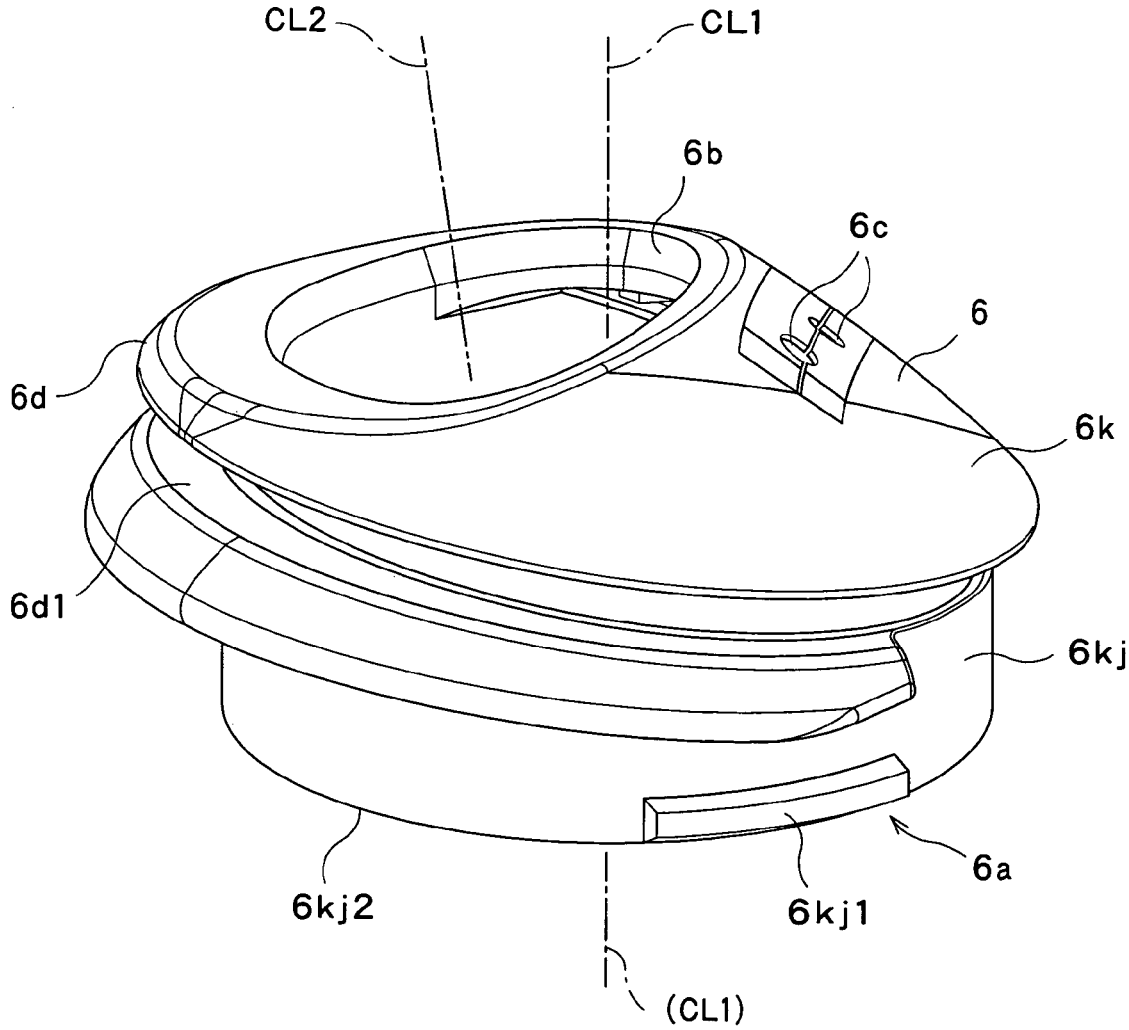
FIG. 4 shows a perspective view of a housing for a headphone set according to the present invention.

The housing 6 is formed by injection molding with resin, such as, ABS (Acrylonitrile Butadiene Styrene) resin, as having the truncated-cone hollow base 6*k* and the ring member 6*kj* provided at the larger diameter side of the base 6*k*, as described above and shown in FIG. 3 and also FIG. 4, a perspective view showing the appearance of the housing 4.

The housing 6 is formed such that a transverse plane of the circular-like opening 6*a* at the ring member 6*kj* in the larger diameter side and a transverse plane of the circular-like opening 6*b* in the smaller diameter side are made unparallel to each other, thus an center axis CL1 of the opening 6*a* and an center axis CL2 of the opening 6*b* being unparallel to each other and not coinciding with each other.

The center axis CL1 in the larger diameter side of the housing 6 substantially coincides with a drive axis SPZ (FIG. 3) of the speaker unit 7. In contrast, the center axis CL2 in the smaller diameter side of the housing 6 is adjusted as being located in the rear head side of a user with respect to the center axis CL1, as shown in (e) of FIG. 2, when the user attaches the left-ear speaker section 1L to his or her left ear.

Provided to the truncated-cone-like hollow base 6*k* of the housing 6 with the unparallel and eccentric larger and smaller diameter sections are through holes 6*c* that connect the inner space (a back cavity BC shown in FIG. 3) and the outside. In this embodiment, three through holes 6*c* are provided near the opening 6*b* in the smaller diameter side, each having a diameter of 0.4 mm, on the circumference of a circle with the center axis CL2 at a substantially equal interval, as shown in (a) of FIG. 2.

Provided at an outer surface 6*d* of the housing 6 near the border between the base 6*k* and the ring member 6*kji* is an arc-like concave section 6*d*1 with which the ear pad 10 is engaged, as described later in detail. As shown in (d) of FIG. 2, the concave section 6*d*1 is provided along a plane PL2 that is inclined at an angle θ2 to a plane PL1 that lies as perpendicular to the center axis CL1 in the larger diameter side of the housing 6. The angle θ2 is 13 degrees in this embodiment.

Provided at an outer surface edge of the ring member 6*kj* are a plurality of protruding members 6*kj*1 that stick out from the ring member 6*kj*. Provided in this embodiment is a pair of protruding members 6*kj* as being apart from each other at a central angle of about 180 degrees on the outer surface edge of the ring member 6*kj*1. The protruding members 6*kj*1 are engaged with the unit cover 9.

The flat cylindrical speaker unit 7 shown in FIG. 3 is constituted by a vibration plate and a driver for driving the vibration plate (both not shown) installed in a body 7*a* made of a metal or resin.

Provided at one end of the body 7*a* is a flange 7*c*. The other end of the body 7*a* is a sound emitting surface 7*b* through which sounds from the vibration plate are given off outside.

Figure 5:
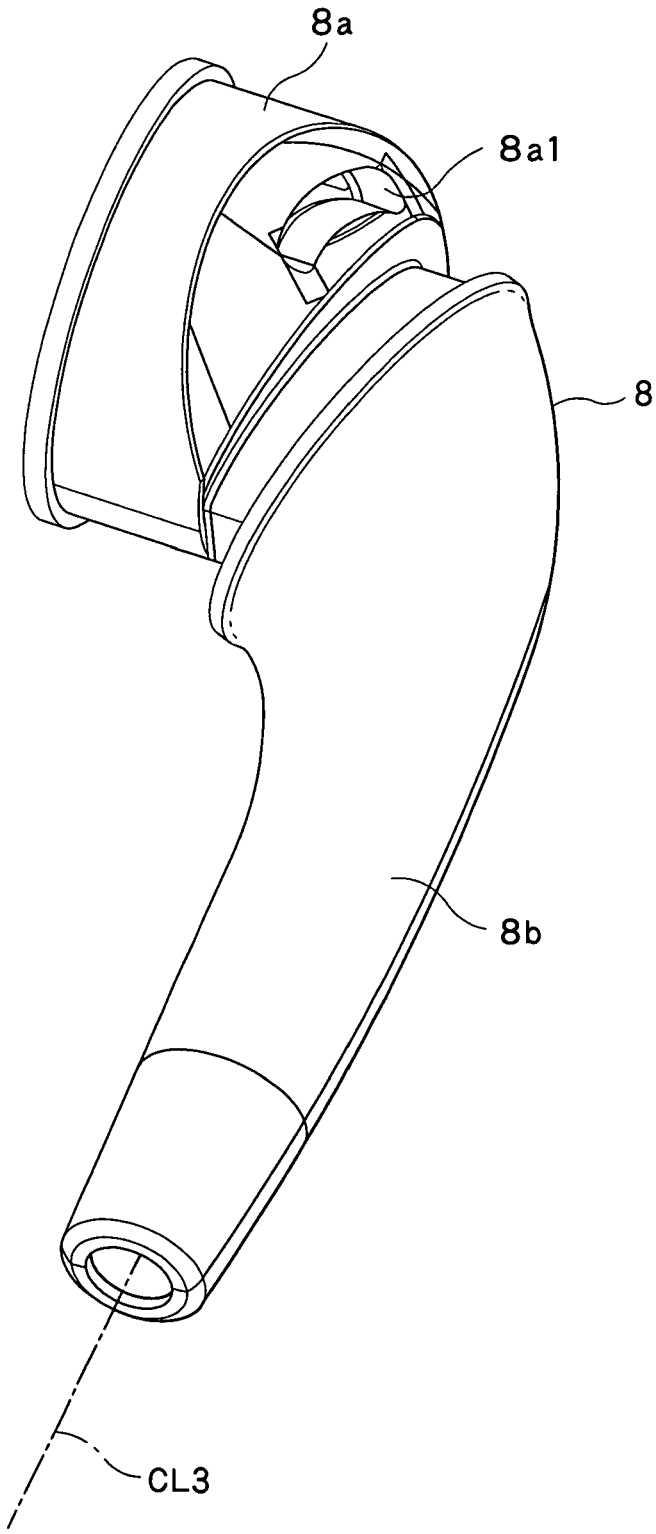
FIG. 5 shows a perspective view of a bushing for a headphone set according to the present invention.

As shown in FIGS. 3 and 5, the bushing 8 is made of an elastomer hollow body, provided with a circular fitting brim 8*a* inserted into the housing 6 so that the bushing 8 is attached to the housing 6. An opening 8*a*1 is provided to the fitting brim 8*a* so as to meet the through holes 6*c* of the housing 6. Through the opening 8*a*1 and the through holes 6*c*, the back cavity BC, the inner space of the left-ear speaker section 1L, is connected to the outside.

The bushing 8 is provided with a cord protector 8*b* made of an elastomer material as being bent along the center axis CL3 lying at a specific angle θ4 with respect to the center axis CL2, as shown in (b) of FIG. 2. The angle θ4 is, for example, in the range from about 80 degrees to about 100 degrees.

The unit cover 9, made of injection molding with resin, such as, ABS resin, is provided for protection of the speaker unit 7. The unit cover 9 is constituted by: a circular base section 9*k* provided with a plurality of sound emitting holes 9*a* (not shown in FIG. 3) that allow sounds emitted from the sound emitting surface 7*b* to pass through; and a circumferential section 9*b* formed, with a circular wall, around the base section 9*k*, as shown in FIG. 6.

The outer surface of the base section 9*k* is an almost flat sound emitting surface 9*k*1.

Figure 6:
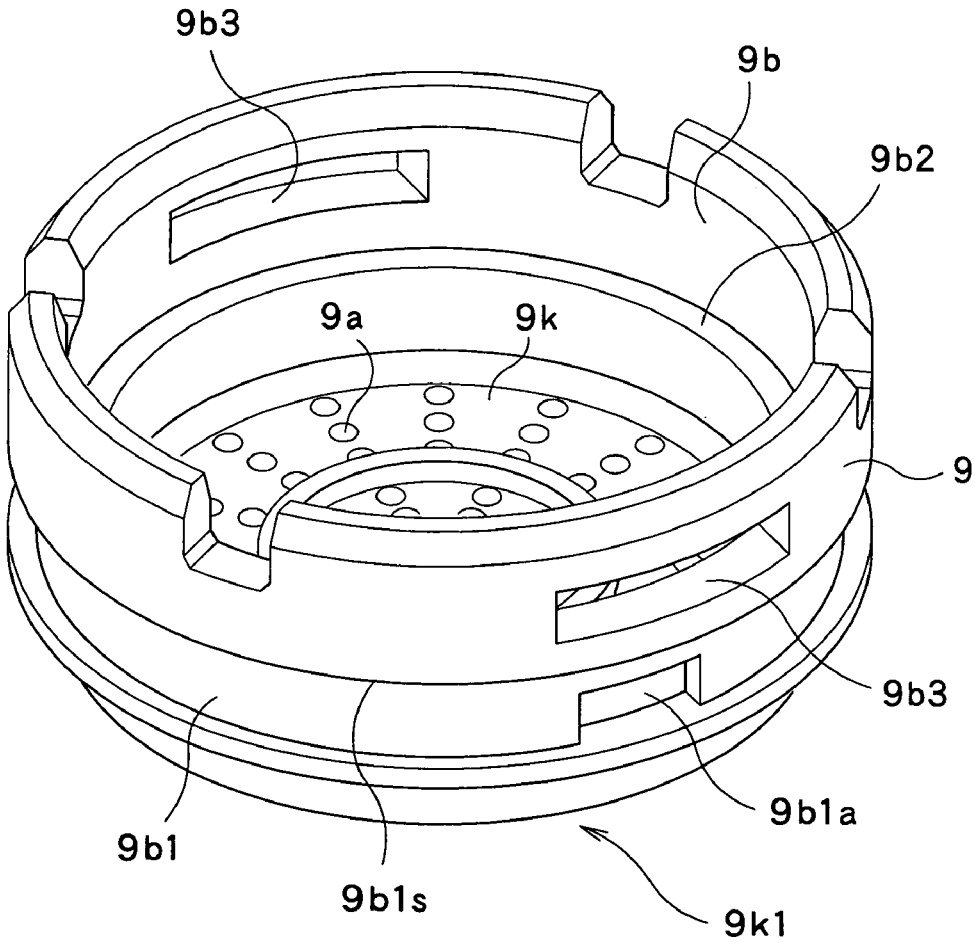
FIG. 6 shows a perspective view of a unit cover for a headphone set according to the present invention.

Provided to the circular wall of the circumferential section 9*b* is a circular concave section 9*b*1 having a plurality of deep concave sections 9*b*1*a* provided at a specific interval on the concave section 9*b*1, such as, two deep concave section 9*b*1*a* at a central angle of about 180 degrees, as shown in FIG. 6.

The unit cover 9 is engaged with the ear pad 10 with the circular concave section 9*b*1 and the deep concave sections 9*b*1*a*, which will be described later in detail.

Moreover, provided to the circular wall of the circumferential section 9*b*, that is protruding when viewed from the circular concave section 9*b*1, are a plurality of long openings 9*b*3 at a specific interval on the circumferential section 9*b*, such as, two long openings 9*b*3 at a central angle of about 180 degrees, as shown in FIG. 6.

Figure 9:
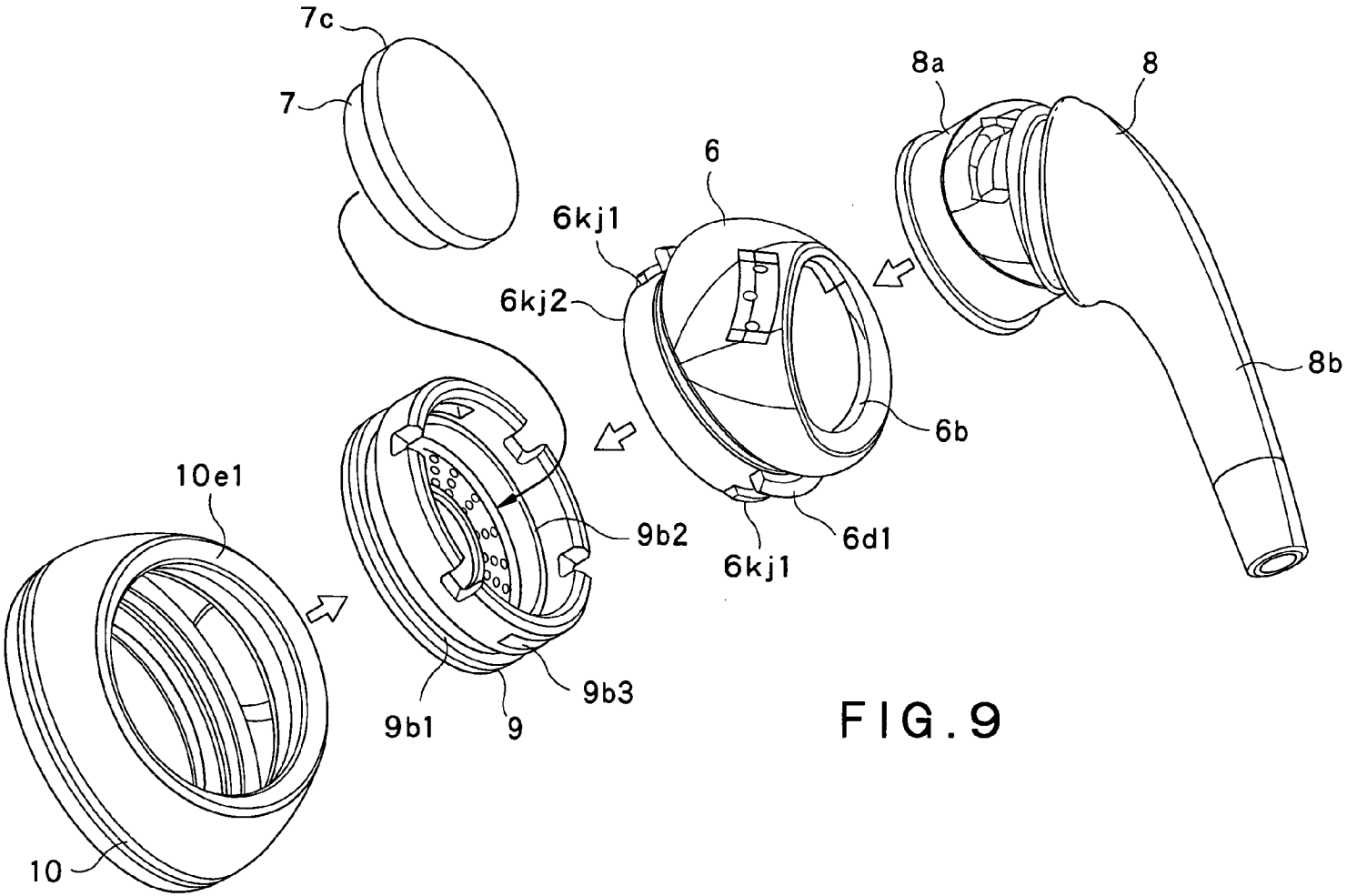
FIG. 9 shows an exploded perspective view of the speaker section for a headphone set according to the present invention.

Fit into the long openings 9*b*3 are the protruding sections 6*kj*1 of the ring member 6*kj* of the housing 6, as shown in FIG. 9.

Formed inside the circumferential section 9*b* of the unit cover 9 is a circular stepped section 9*b*2 having a smaller diameter at the base section 9*k* side.

The speaker unit 7 is installed in the left-ear speaker section 1L with the flange 7*c* fit between the stepped section 9*b*2 of the unit cover 9 and an edge surface 6*kj*2 of the ring member 6*kj* of the housing 6 at the larger diameter side, as shown in FIG. 9.

Described next is the ear pad 10 with respect to FIGS. 2, 3, and 7.

The ear pad 10 is a circular member made of a flexible material such as silicon rubber, which has a hollow body with egg-like truncated-cone shaped top and bottom surfaces 10*tp* and 10btm (first top and bottom sections, respectively) each with an opening.

Shown in (e) of FIG. 2 is the ear pad 10 at the bottom surface 10btm side with an egg-like shape when projected onto a plane substantially parallel to the sound emitting surface 9*k*1 (FIG. 6).

Figure 7:
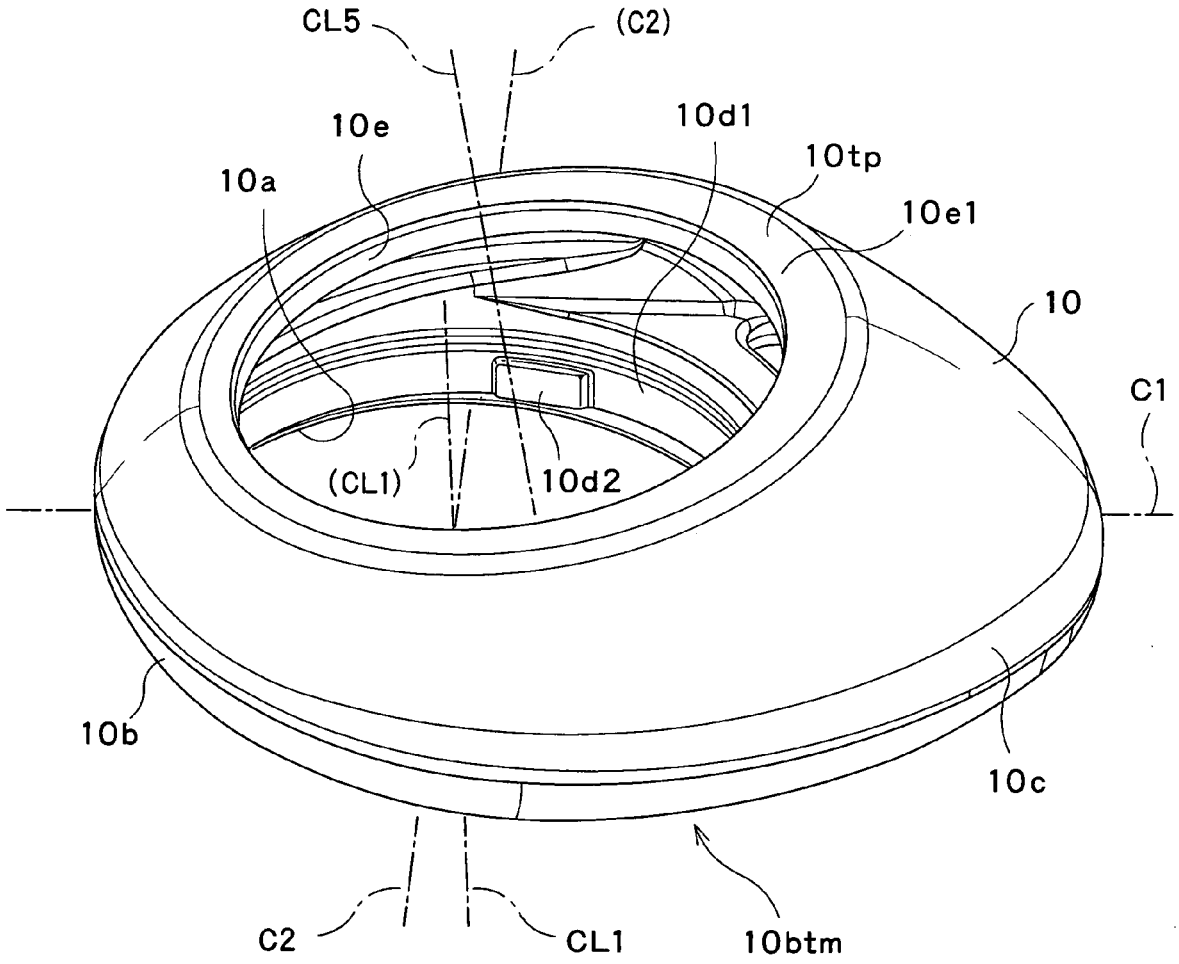
FIG. 7 shows a perspective view of an ear pad for a headphone set according to the present invention.

As shown in (e) of FIG. 2 and FIG. 7, the ear pad 10 is provided with a substantially circular opening 10*a* at the bottom surface 10btm with the center axis CL1. Moreover, as shown in (d) of FIG. 2 and FIG. 7, the ear pad 10 is provided with a substantially circular opening 10*e* at the top surface 10top with a center axis CL5.

The top and bottom surfaces 10top and 10btm are provided so that the center axes CL1 and CL5 do not agree with each other.

The ear pad 10 is provided with an arc-like member 10*b* and a protruding member 10*c*. These members are provided as described below when axes C1 and C2 are set as perpendicular to each other, as shown in (e) of FIG. 2. The arc-like member 10*b* is provided as having an ark-like shape at the right side of the axis C2, as coaxial with the opening 10*a*. The protruding member 10*c* is provided as protruding in the left side of the axis C2 in the direction of the axis C1 that connects the center axis CL1 of the opening 10*a* to a protruding summit 10*p* of the protruding member 10*c* in a plane that includes the protruding summit 10*p* and the center axis CL1 when viewed from the sound emitting surface 9*k*1.

The axis C1 is defined as having an angle θ3 of about 71 degrees (that gives an angle θ5 of 109°=180°−71°) with respect to the center axis CL3 that lies in the direction in which the cord protector 8*b* is extending, as shown in (e) of FIG. 2.

In detail, as shown in (e) of FIG. 2, the bushing 8 is provided with the cord protector 8*b* for protecting the cord 2L that is extended in a specific direction, with a segment CL3B of the center axis CL3, that passes through the cord protector 8*b*, having the angle θ3 smaller than 90 degrees with respect to a reference segment CL1B (with an angle of 0 degrees) that connects a crossing of the axes C1 and C2 (agreeing with the center axis CL1) to the summit 10*p* of the protruding member 10*c* and having the specific angle θ5 larger than 90 degrees in a direction in which the segment CL3B is apart from the protruding member 10*c*.

The angle θ5 is expressed as θ5=180°−θ3, which is larger than 90 degrees a little bit, suitable for many users, although depending on the position of the incisura intertragica of user's ear auricle, which will be discussed later with respect to FIG. 11. A feasible range of the angle θ5 is 90°<θ5<115°.

The arc-like member 10*b* may not have a shape of an arc of a circle of perfect roundness. It may be a part of an ellipse or any curve with continuous change in curvature.

As shown in FIG. 3, a circumferential wall member 10*d* is provided at the edge of the opening 10*a* (FIG. 7) in the protruding member 10*c* side, that stands in the direction parallel to the center axis CL1.

Provided to the circumferential wall member 10*d* is a circumferential protruding section 10*d*1 that circumferentially sticks out from the wall member 10*d* to the inside of the ear pad 10. The protruding section 10*d*1 is formed almost over the circumference of the opening 10*a* including the protruding member 10*c* side and also the arc-like member 10*b* side.

Formed along the circumferential protruding section 10*d*1 are a plurality of high protruding sections 10*d*2, for example, two high protruding sections 10*d*1 apart from each other at a central angle of about 180 degrees with respect to the opening 10*a*, as shown in FIG. 7.

The locations of the circumferential protruding section 10*d*1 in the circumferential direction match those of the deep concave sections 9*b*1*a* (FIG. 6) so that the protruding sections 10*d*1 can be fit into the concave sections 9*b*1*a* when the ear pad 10 is attached to the unit cover 9.

The top surface 10*tp* of the ear pad 10 is provided on a plane PL2 having an angle of θ2 with respect to a plane PL3 including the bottom surface 10btm, as shown in (d) of FIG. 2. Provided to the top surface 10*tp* is a substantially circular opening 10*e*, as shown in FIG. 7. Provided to the opening 10*e* is a brim member 10*e*1 formed at the edge of the opening 10*e* and lying in the plane PL2, to be engaged with the arc-like concave section 6*d*1 of the housing 6, as shown in FIG. 3.

The ear pad 10 is formed very thin in relation to its outer size, for example, about 1 mm in thickness relative to 17 mm in outer size Øn shown in (c) of FIG. 2.

Figure 13:
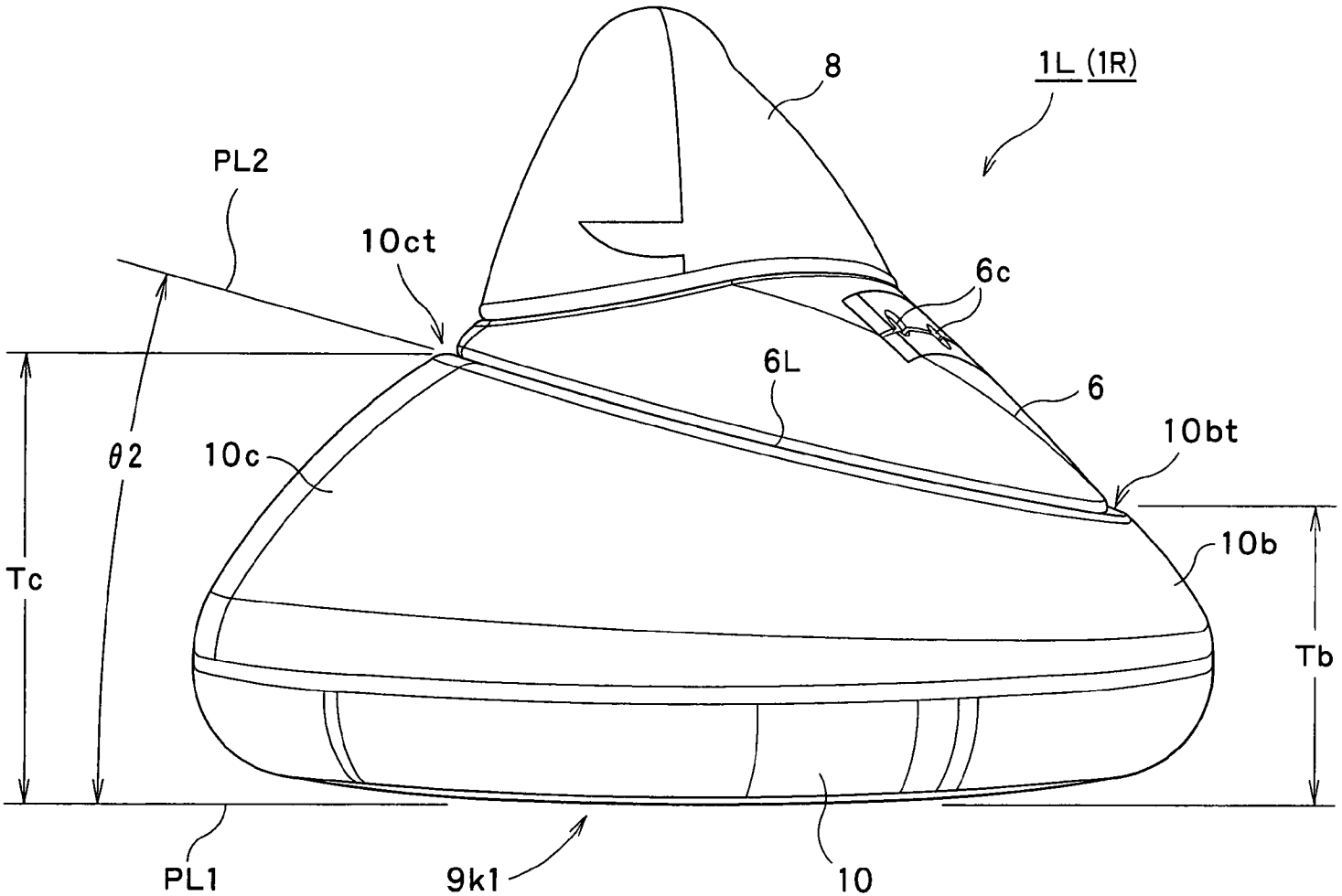
FIG. 13 shows a view of an appearance of a speaker section for the headphone set according to the present invention, in the same direction as in FIG. 12.

As shown in FIG. 13, the protruding member 10*c* is formed as having an inner space S whereas the arc-like member 10*b* is formed as having almost no inner spaces.

Figure 8:
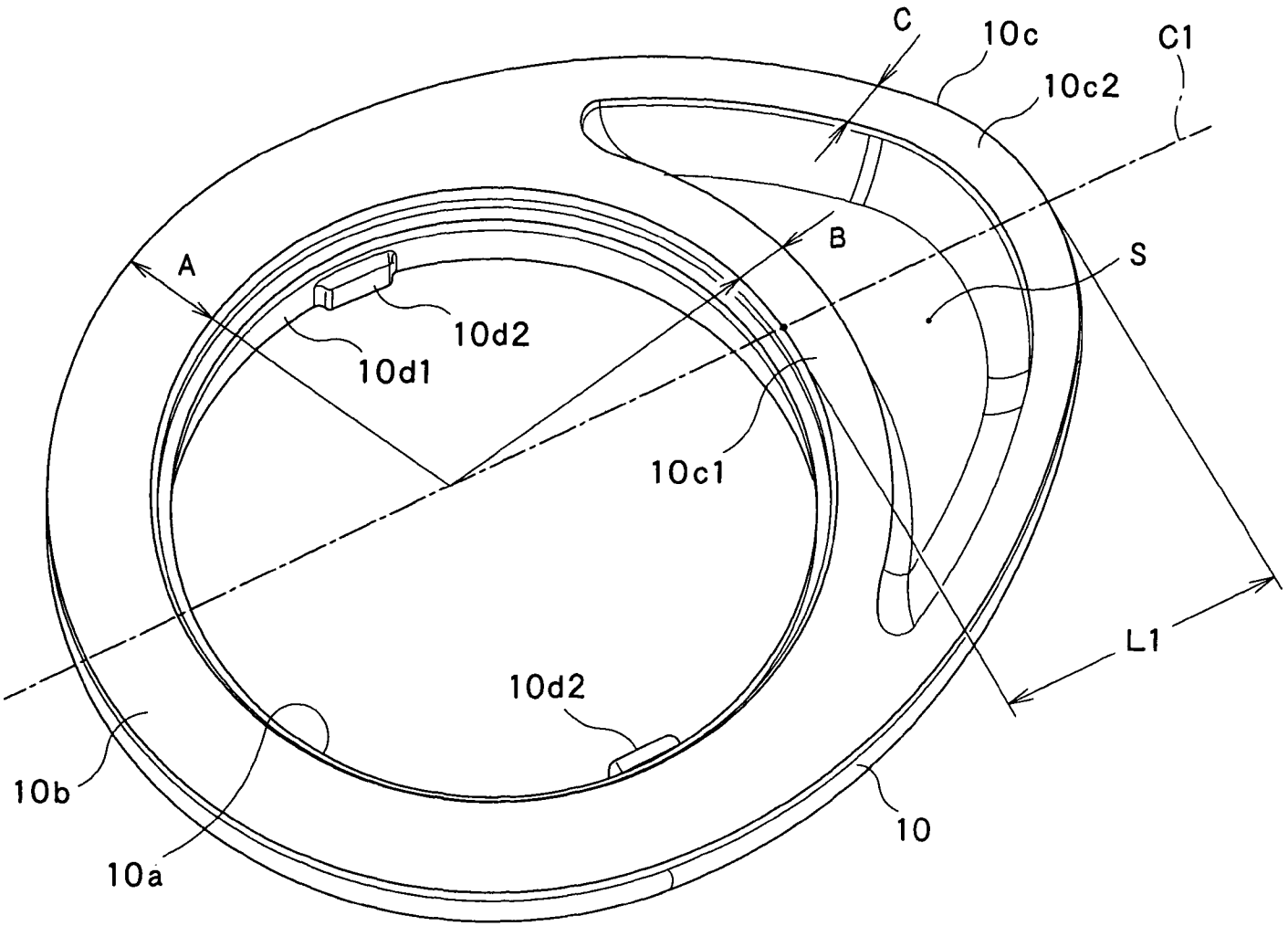
FIG. 8 that shows a sectional view of the ear pad, taken on line S2-S2 of FIG. 3.

The inner space S is discussed with respect to FIG. 8 that shows a sectional view of the ear pad 10, taken on line S2-S2 of FIG. 3, just above the circumferential protruding section 10*d*1.

As shown in FIG. 8, the arc-like member 10*b* is formed as having a substantially constant thickness A in the radial direction whereas the protruding member 10*c* is formed as protruding from the opening 10*a* by a distance L1 that is larger than the thickness A, thus creating the inner space S.

Usually, not only the arc-like member 10*b*, but also the protruding member 10*c* is formed as having the thickness A for the constant quality of the ear pad 10. However, since the inner space S is one of the important features of the present invention, the protruding member 10*c* is formed as having the distance L1 larger than the thickness A.

The thicknesses defined in FIG. 8, in addition to the thickness A are a thickness B of an inner wall section 10*c*1 in the radial direction and a thickness C of an outer wall section 10*c*2 in the radial direction. The inner wall section 10*c*1 having the circumferential protruding section 10*d*1 and the outer wall section 10*c*2 which can be seen from the outside create the inner space S. The thickness B is adjusted as smaller than the thickness A and the thickness C is adjusted as smaller than the thickness B. For example, the thicknesses B and C are 1.3 mm and 0.8 mm, respectively, to the thickness A of 2.2 mm, with the distance L1 of 7.6 mm.

The outer wall section 10*c*2 of the ear pad 10 is thus formed as being relatively thin with the inner space S so that it is easily deformed when pushed or pinched by a user.

The inner space S discussed above gives higher flexibility to the protruding member 10*c* made of a flexible material so that the member 10*c* can be deformed into any shape.

Described next is how the left-ear speaker section 1L is assembled, with respect to FIGS. 3 and 9. FIG. 9 is an exploded perspective view of the speaker section 1L, without showing the cord 2L.

The bushing 8 is attached to the housing 6. In detail, while the circular fitting brim 8*a* of the bushing 8 is being deformed, it is fit into the opening 6*b* of the housing 6 at the smaller diameter side. An adhesive is applied through the opening 6*a* of the housing 6 at the larger diameter side to fix the bushing 8 to the housing 6.

The speaker unit 7 is fixed to the unit cover 9 with an adhesive so that the flange 7*c* touches the circular stepped section 9*b*2 to be positioned with respect to the center axis CL1 (FIG. 3).

The housing 6 is attached to the unit cover 9 with a snap-fit connection for the engagement of the openings 9*b*3 of the housing 6 and the protruding sections 6*kj*1 of the unit cover 9.

With the snap-fit connection, the edge surface 6*kj*2 (FIG. 3) of each protruding section 6*kj*1 of the housing 6 touches the speaker unit 7 so that the speaker unit 7 is firmly held between the edge surface 6*kj*2 and the stepped section 9*b*2 of the unit cover 9.

Then, the ear pad 10 is attached to a housing body KT assembled with the housing 6, the bushing 8, and the unit cover 9.

Figure 10:
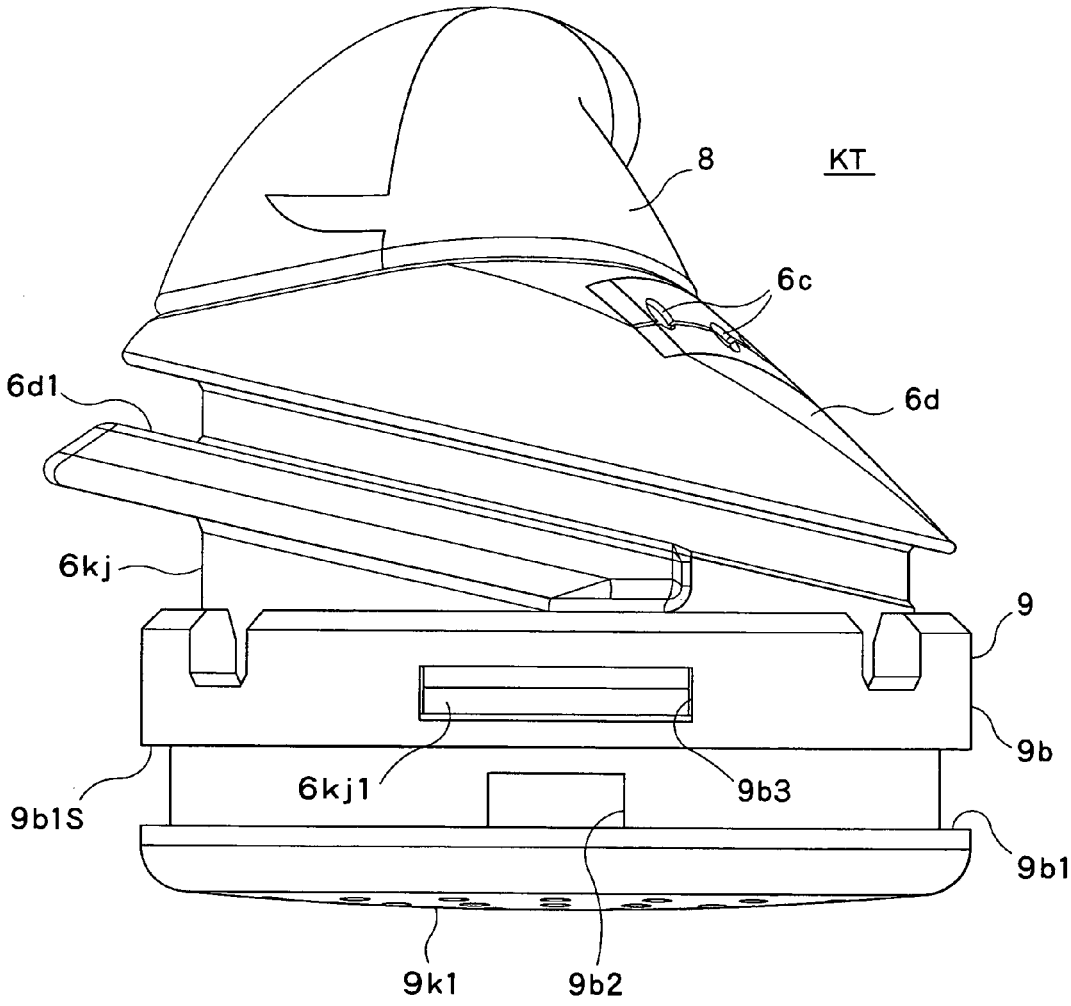
FIG. 10 shows a view of an assembled housing body for a headphone set according to the present invention.

As shown in FIG. 10 corresponding to (d) of FIG. 2, the housing body KT includes the speaker unit 7 therein, which is installed as described above.

The ear pad 10 is attached to the housing body KT so that the brim member 10*e*1 and the circumferential protruding section 10*d*1 of the ear pad 10 (FIG. 7) are fit into the concave section 6*d*1 and the concave section 9*b*1, respectively. At the same time, the high protruding sections 10*d*2 are fit into the deep concave sections 9*b*1*a* (FIG. 6) for positioning of the ear pad 10 and the housing body KT in the circumferential direction.

Figure 11:
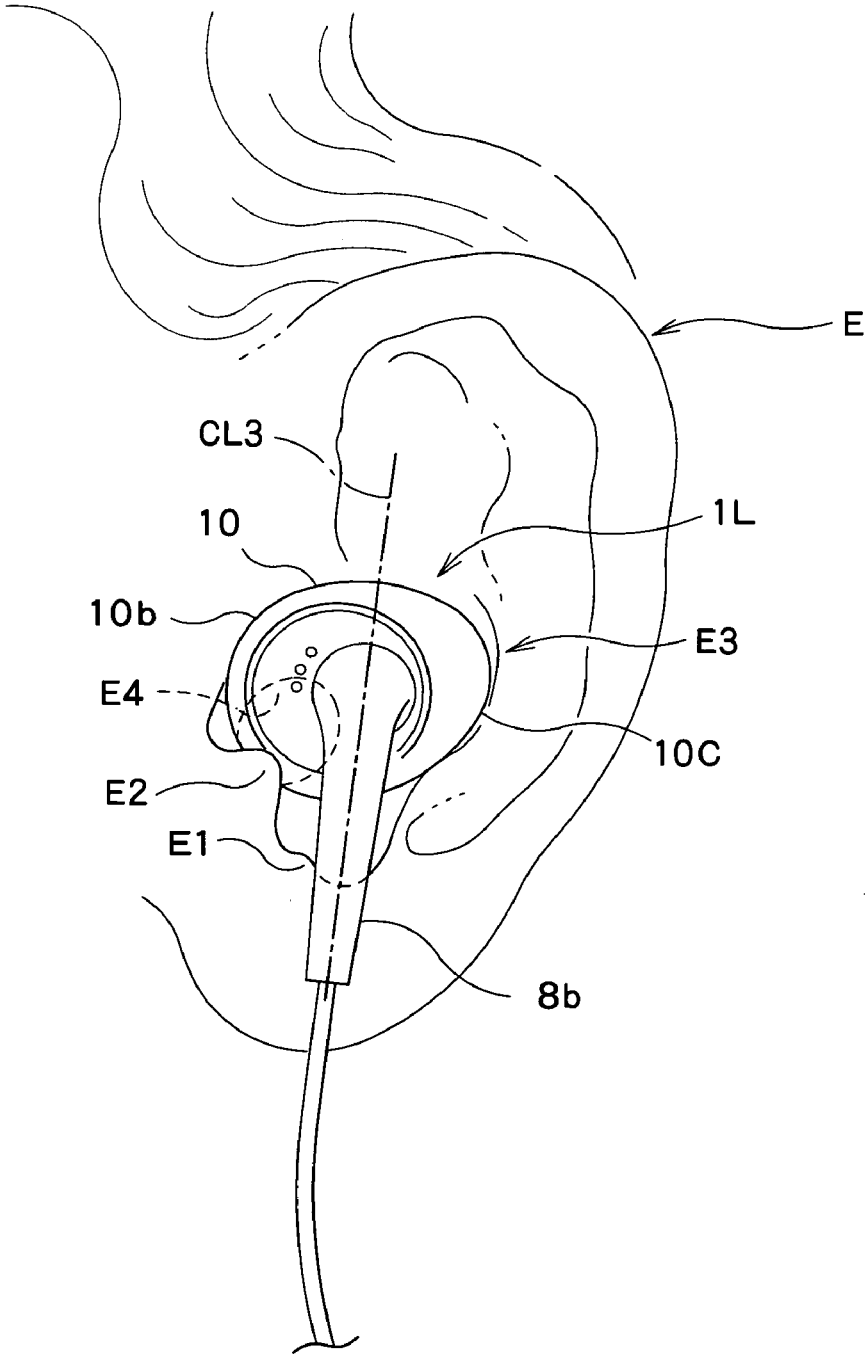
FIG. 11 shows a view illustrating a headphone set according to the present invention, attached to a user's ear.

Explained next with respect to FIG. 11 is how the left-ear speaker section 1L of the headphone set 50 is fit into a user's left ear. The same explanation is applied to the right-ear speaker section 1R of the headphone set 50 to a user's right ear.

In FIG. 11, the left-ear speaker section 1L of the headphone set 50 is fit into a user's left ear such that the cord protector 8*b* of the bushing 8 is fit into an incisura intertragica E1 of a user's auricle E, and the ear pad 10 is fit into a tragus E2 of the auricle E at the arc-like member 10*b* side while the protruding member 10*c* elastically touches an inner wall E3 of the auricle E.

The positioning of the left-ear speaker section 1L in a user's left ear is roughly made with the arc-like member 10*b* and the cord protector 8*b*, with the protruding member 10*c* elastically touching the inner wall E3 of the auricle E so that the speaker section 1L is hardly detached from the auricle E.

As described above, the ear pad 10 made of a flexible material such as silicon rubber is softly and comfortably fit into a user's auricle. In addition, the cord protector 8*b* made of an elastomer material is softly and comfortably attached to a user's auricle.

Moreover, when the ear pad 10 is attached to the auricle E, the protruding member 10*c* made of a flexible material and provided with the inner space S (FIG. 3) is easily deformed in accordance with the shape of the inner wall E3 and gives a constant and moderate pressure to the zone of the inner wall E3 which the protruding member 10*c* touches. The pressure is given by a repulsion force that is created when the protruding member 10*c* touches the inner wall E3, which will be discussed later.

Although the distance between the tragus E2 and the inner wall E3 depends on users, the inner space S allows the protruding member 10*c* to be greatly deformed in a wide area so that the ear pad 10 is comfortably attached to a user's ear irrespective of variation in size of the protruding member 10*c* due to mass production and also variation in shape of the tragus of users' ears.

The entrance of an external auditory canal E4 is located at the tragus E2 side, as shown by a dotted circle, with respect to the center axis CL3 (FIG. 2) of the cord protector 8*b* that is fit in the incisura intertragica E1. In order to mach the location of the entrance of the external auditory canal E4, the drive axis SPZ (FIG. 3) of the speaker unit 7 is located at the arc-like member 10*b* side with respect to the center axis CL3.

When the left-ear speaker section 1L is attached to the auricle E, the base 6*k* of the housing 6 having the through holes 6*c* is partially covered with the tragus E2. The through holes 6*c* are located near the opening 6*b* of the smaller diameter side or the bushing 8 side far from the larger diameter side, as shown in FIG. 3. The location allows the through holes 6*c* to be uncovered with the tragus E2, which could otherwise be covered because the size and shape of the tragus E2 depend on users. Moreover, the through holes 6*c* are located apart from the tragus E2 in the radial direction and separated from one another in the anticlockwise and circumferential direction.

Figure 12:
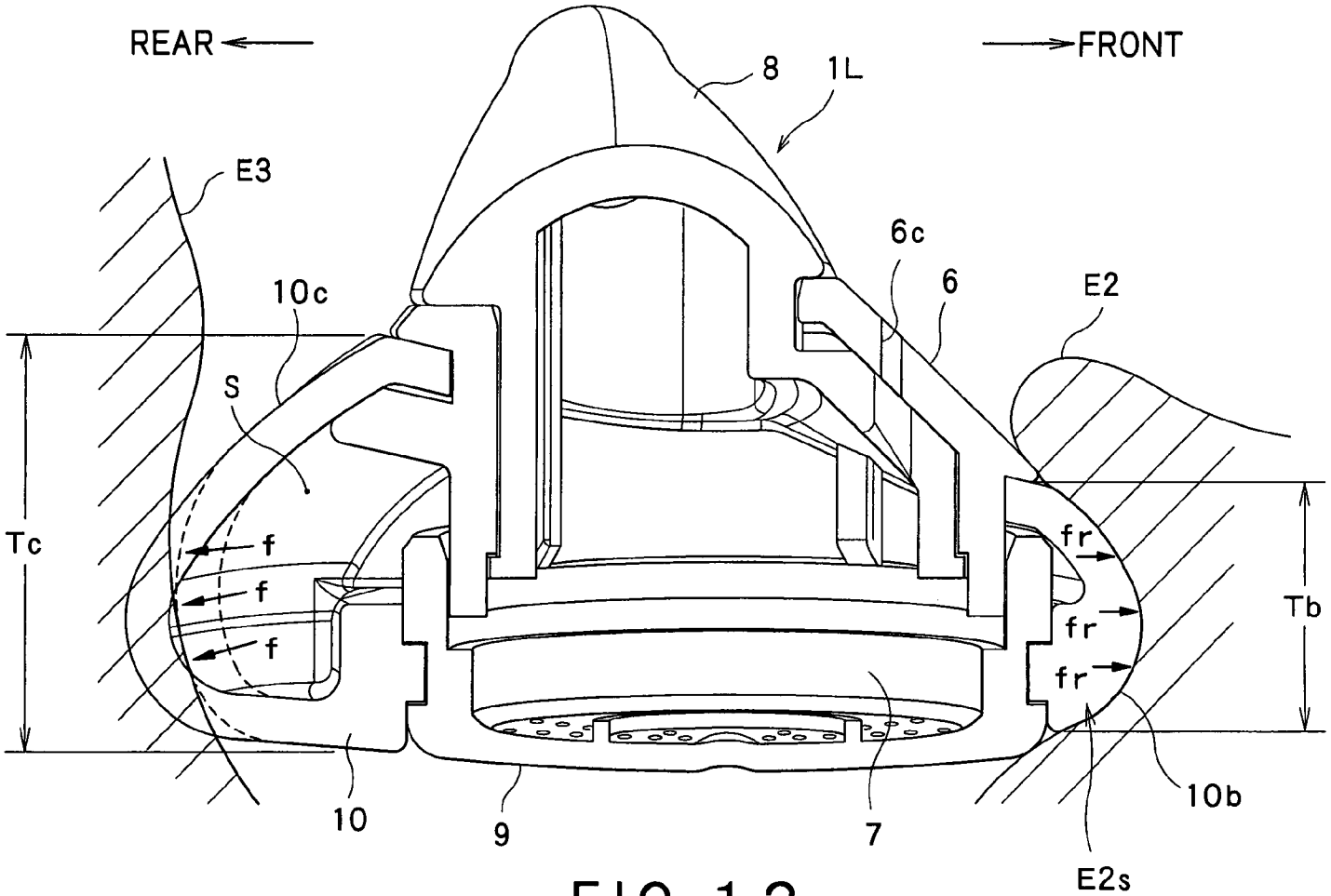
FIG. 12 shows a view illustrating a headphone set according to the present invention, attached to a user's ear.

Discussed next with respect to FIG. 12 is how the left-ear speaker section 1L is attached to the auricle E in view of the depth direction of the auricle E.

FIG. 12 shows a sectional view of the left-ear speaker section 1L cut in the plane of the maximum width in the front direction (a user's face side) and the rear direction of a user's head and viewed from above the user's head.

The arc-like member 10*b* of the ear pad 10 is fit in the tragus E2 and positioned there. While the arc-like member 10*b* is positioned, the protruding member 10*c* touches the inner wall E3 and is deformed inwardly in accordance with the shape of the inner wall E3, which creates a repulsion force "f" to press the inner wall E3. The repulsion force "f" gives a reaction force "fr" to the arc-like member 10*b* to press the inner wall of the tragus E2. These forces allow the left-ear speaker section 1L to be firmly held in the auricle E (FIG. 11).

In a user's left ear, as illustrated in FIG. 12, the tragus E2 creates a relatively narrow space E2*s* for the arc-like member 10*b* whereas the inner wall E3 is a relatively long wall for the protruding member 10*c*.

Under consideration of such a shape of user's ear, the arc-like member 10*b* is made as having a thickness Tb smaller than a thickness Tc of the protruding member 10 (Tb<Tc).

Figure 14:
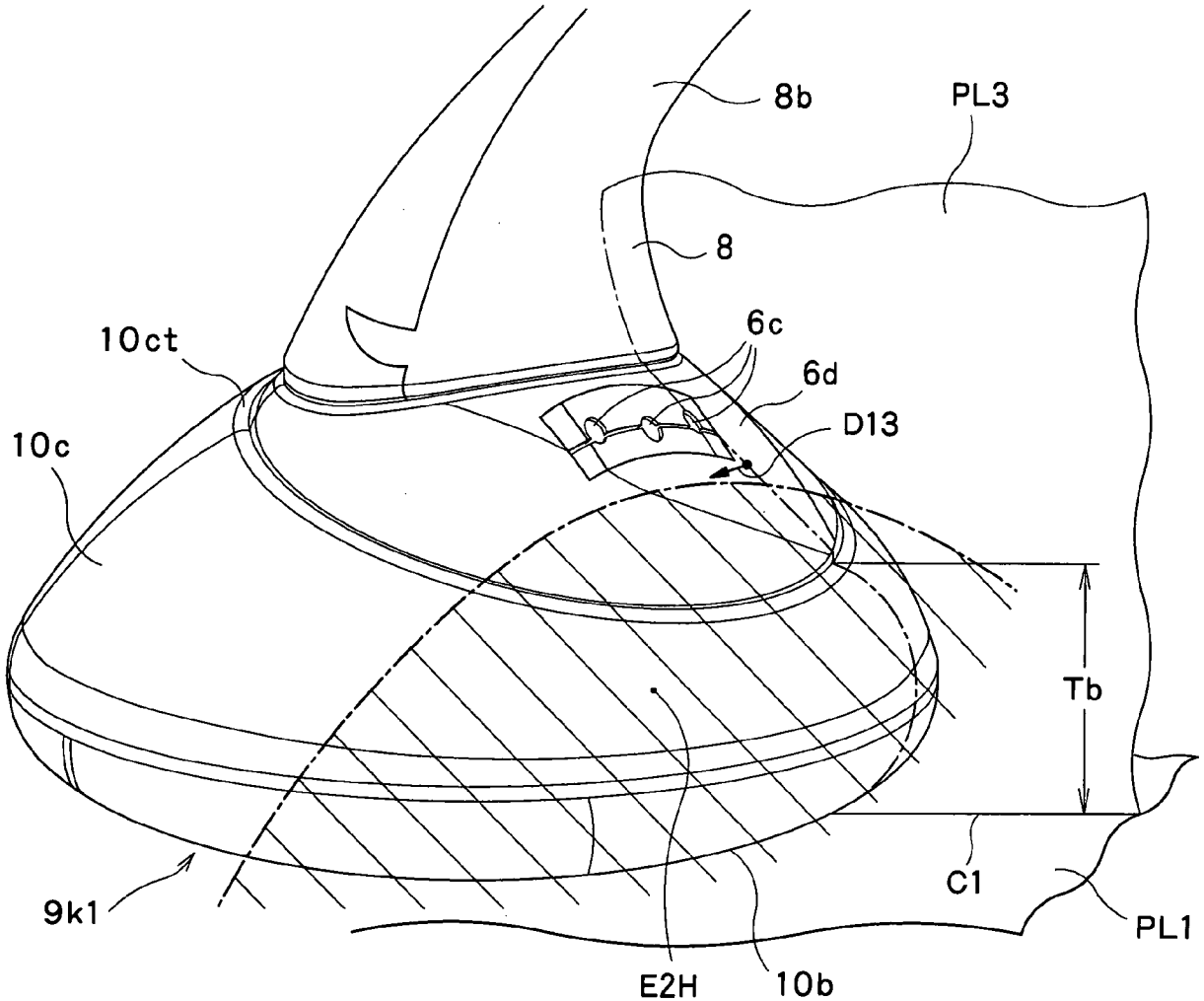
FIG. 14 shows a view illustrating several features of the headphone set according to the present invention.

The thickness is further discussed with respect to FIGS. 13 and 14. FIG. 13 is shows an appearance of the left-ear speaker section 1L in the same direction as in FIG. 12, viewed from above a user's head. FIG. 14 shows a perspective view of the speaker section 1L viewed from a right-upper direction in FIG. 13.

As shown in FIG. 13, the ear pad 10 (made of a flexible material) of the left-ear speaker section 1L is formed as having a relation Tb<Tc. In the relation, Tb denotes the thickness of the arc-like member 10*b* or a distance from of the sound emitting surface 9*k*1 of the unit housing 9 to an end section 10*bt* of the arc-like member 10*b* in the thickness (height) direction and Tc denotes the thickness Tc of the protruding member 10 or a distance from of the sound emitting surface 9*k*1 to an end section 10*ct* of the protruding member 10*c* in the thickness (height) direction.

The end section 10*bt* and another end section of the arc-like member 10*b* separated from the end section 10*bt* by the thickness Tb are refereed to as second top and bottom sections, respectively, with respect to the top and bottom surfaces 10*tp* and 10btm (first top and bottom sections, respectively) of the protruding member 10*c* shown in FIG. 3.

The end sections 10*bt* and 10*ct* are connected to each other by a border line 6L that corresponds to the concaved shape of the arc-like concave section 6*d*1 shown in FIG. 3.

In FIG. 13, the angle θ2 between the plane PL1 that includes the sound emitting surface 9*k*1 and the plane PL2 that includes the border line 6L is 13 degrees, in this embodiment, as described with reference to (d) of FIG. 2, in which the plane PL1 is defined as lying perpendicular to the center axis CL1 in the larger diameter side of the housing 6.

Discussed next with reference to FIG. 14 a positional relationship between a zone E2H (indicated by oblique lines) to be covered with the user's tragus E2 (FIG. 11) and the through holes 6*c*.

The ear pad 10 is made thicker at the protruding member 10*c* side in order to obtain an enough repulsion force when the protruding member 10*c* touches the inner wall E3, as discussed with reference to FIG. 11. The thicker structure at the member 10*c* side makes the location of the end section 10*ct* of the member 10*c* closer to the bushing 8, which gives a narrower space for the through holes 6*c*.

In contrast, the ear pad 10 is made thinner at the arc-like member 10*b* side. The thinner structure at the member 10*b* side makes the location of the end section 10*bt* of the member 10*b* far from the bushing 8, which gives a wider space (the outer surface 6*d* of the housing 6) for the through holes 6*c*.

Therefore, the through holes 6*c* are provided on the outer surface 6*d* of the housing 6 at the arc-like member 10*b* side, as closer to the bushing 8 and in a direction dedicated by an arrow D13, as shown in FIG. 14, with respect to a plane PL3 that is perpendicular to the plane PL1 that includes the sound emitting surface 9*k*1 and the axis C1 in which direction the protruding member 10*c* sticks out.

The through holes 6*c* are provided at the specific locations, as discussed above, for air to be let in and out between the outside and the back cavity BC, to gain excellent acoustic characteristics, with respect to the inner space S of the protruding member 10*c* having a relatively large volume for higher elasticity to a user's tragus.

The ear pad 10 fit into the housing body KT that is assembled with the housing 6, the bushing 8, and the unit cover 9, as described above, may be fixed firmly with an adhesive, thus not detachable.

Described next is a modification to the headphone set 50, with reference to FIGS. 15 to 17.

A headphone set 51, a modification to the headphone set 50, has a housing body KT1 with a different shape from the housing body KT for the section to which the ear pad 10 is attached. Like the housing body KT, however, the housing body KT1 contains the speaker unit 7.

The same or analogous elements or components of the modification are given the same reference signs or numerals as the embodiment and the explanation thereof is omitted if not necessary.

Although the housing body KT allows a user to easily detach the ear pad 10 when he or she wants to exchange it with a new ear pad, the housing body KT1 is advantageous over housing body KT in ear-pad detachablility.

An ear-pad detachable structure allows a user to: wash a detached ear pad 10; exchange a damaged ear pad 10 with a new one; exchange the ear pad 10 with a new one with a different shape or size of the protruding member 10*c*, depending on a user's ear shape or size; exchange the ear pad 10 with a new one with a different color or made of a different material, depending on user's preferences, etc.

The headphone set 50 with the ear-pad detachable structure requires that the ear pad 10 be not easily detached from the housing body KT in a normal use.

As described above, in order to achieve excellent acoustic characteristics, the headphone set 50 is provided with the back cavity BC and also the inner space S inside the protruding member 10*c*, as shown in FIG. 3, with the inner wall section 10*c*1 of the circumferential protruding section 10*d*1 to be engaged with the housing body KT, having the thickness B in the radial direction smaller than the other thicknesses, such as the thickness A, as shown in FIG. 8.

The structure described above has advantages in that the ear pad 10 is not easily detached from the housing body KT in a normal use against an external force to be applied in a direction depicted by an arrow D4 in FIG. 3 from the bushing 8 side, because: the external force can be received by the brim member 10*e*1 (of the ear pad 10) and the concave section 6*d*1 (of the housing body KT) engaged with each other; and the external force is not directly applied to the protruding member 10*c* (of the ear pad 10) due to its curved surface at the bushing 8 side.

Nevertheless, the structure described above has disadvantages in that the ear pad 10 is relatively easily detached from the housing body KT against an external force to be applied in a direction depicted by an arrow D5 in FIG. 3 at the engaged section of the inner wall section 10*c*1 (FIG. 8) from the sound emitting surface 9*k*1 side, because: the external force can not be received by the brim member 10*e*1 (of the ear pad 10) and of the concave section 6*d*1 (of the housing body KT) engaged with each other; and the bottom surface 10btm of the ear pad 10 is flat, thus being easily applied with an external force.

In order to overcome such disadvantages, compared to the housing body KT, the housing body KT1 is formed as having a longer (deeper) contact length in the radial direction, at which the circumferential protruding section 10*d*1 (of the ear pad 10) and the circular concave section 9*b*1 (of the unit cover 9) touch or contact with each other at the inner wall section 10*c*1 (of the ear pad 10), at least at a far side from the sound emitting surface 9*k*1, where the housing body KT1 and the ear pad 10 are engaged with each other.

Figure 17:
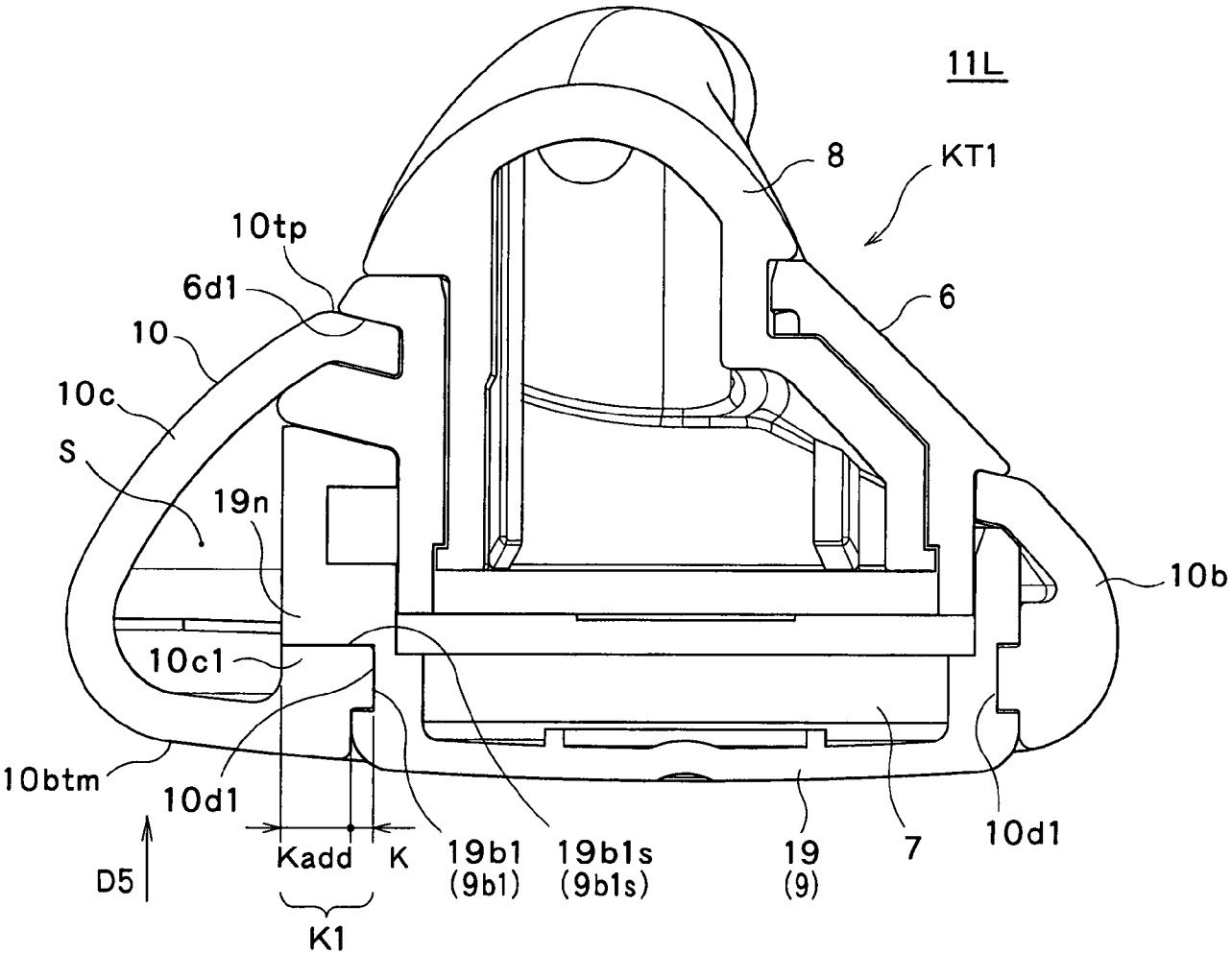
FIG. 17 shows a sectional view of the modification to the headphone set according to the present invention.

In detail, with reference to FIG. 3 and also FIG. 17 that shows a sectional view of a left-ear speaker section 11L in the modification, the housing body KT1 is formed as having a longer contact length at which the circumferential protruding section *d*1 and a circular concave section 19*b*1 touch or contact with each other at a side face 19*b*1*s* (FIG. 17) of the concave section 19*b*1 in the bushing 8 side, than at the corresponding side face 9*b*1*s* (FIG. 3).

The housing body KT1 may also be formed as having such a longer contact length at the sound emitting surface 9*k*1 side, which makes the ear pad 10 be hardly detached against an external force applied in the direction depicted by the arrow D4 in FIG. 3.

The contact length (which is occasionally referred to as a contact zone or an engaging depth, hereinafter) is discussed further with reference to FIGS. 15 to 17.

Figure 15:
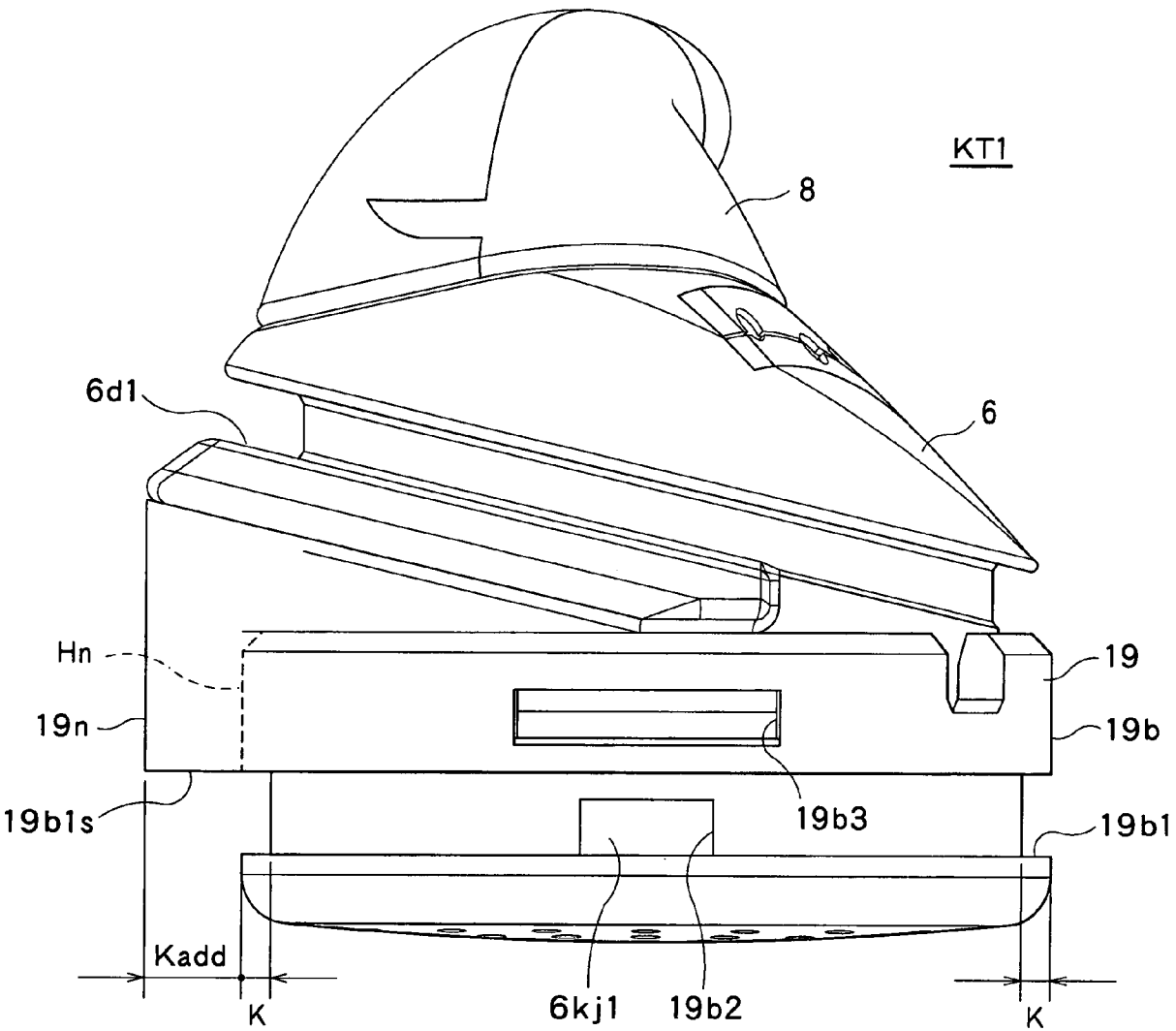
FIG. 15 shows a view of a modification to the headphone set according to the present invention.

As shown in FIG. 15 corresponding to (d) of FIG. 2, and with reference to FIG. 10, the housing body KT1 is assembled with a unit cover 19, in addition to the housing 6 and the bushing 8 (both identical to those of the housing body KT (FIG. 10).

Compared to the unit cover 9 (FIG. 10), the unit cover 19 is provided with a cladding section 19*n* at the left side in FIG. 15, in addition to a circumferential section 19*b*, different from the circumferential section 9*b* (FIG. 10).

A broken line shown in FIG. 15 indicates a contour line of the unit cover 9 (FIG. 10) for comparison between the housing body KT and the housing body KT1.

Figure 16:
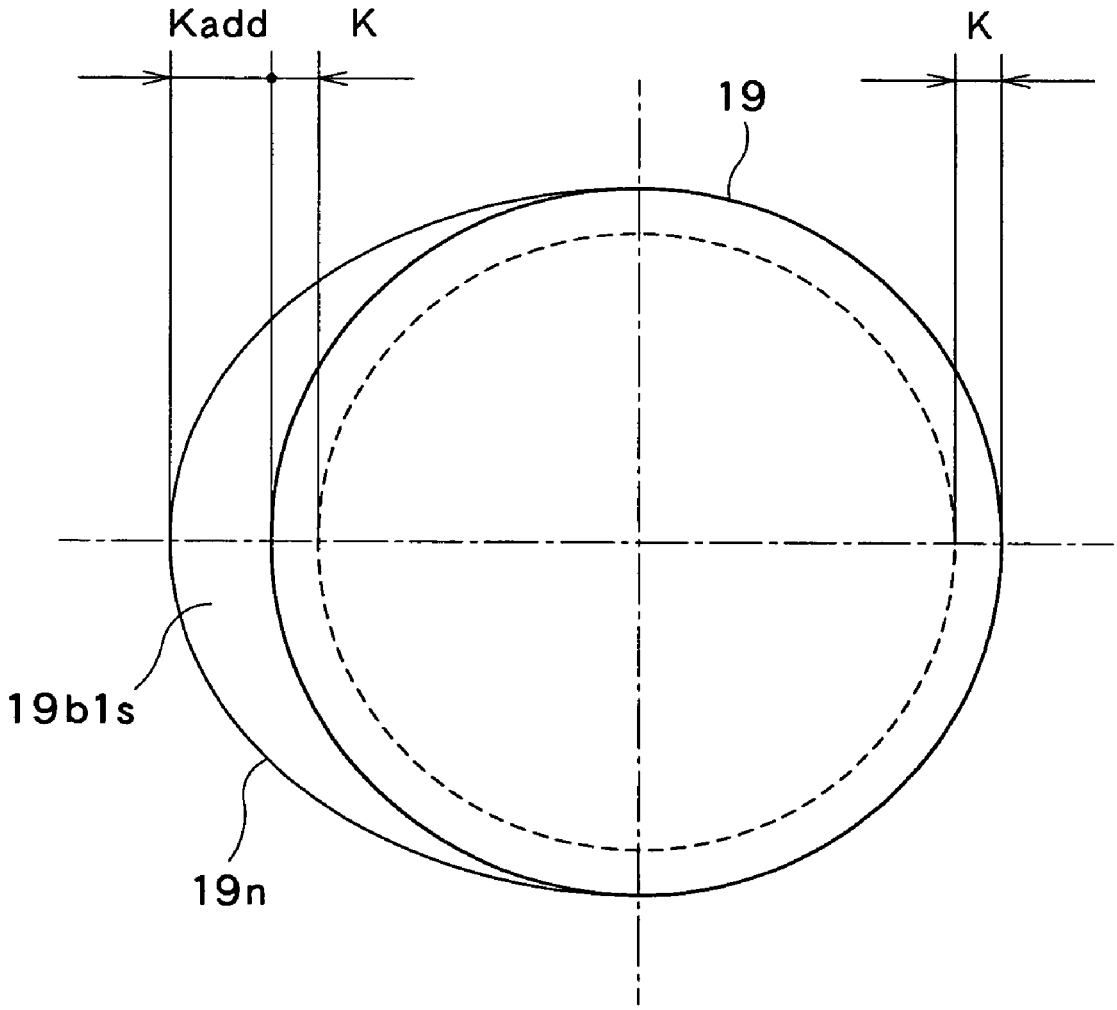
FIG. 16 shows a plan view of the modification to the headphone set according to the present invention.

As shown in FIG. 16 which shows the housing body KT1 viewed from the bottom in FIG. 15, the cladding section 19*n* protrudes from the circumferential section 19*b* (FIG. 15) into a crescent-like shape.

The cladding section 19*n* has a maximum engaging depth or length (contact zone) of K1=K+Kadd>K at the side face 19*b*1*s* of the concave section 19*b*1, in FIGS. 15 and 16, with respect to an engaging depth K that is the engaging depth of the housing body KT and also the engaging depth of the housing body KT1, except for the engaging section at the cladding section 19*n*. The depths are, for example, K=0.4 mm and Kadd=1.3 mm.

The maximum engaging depth of K1=K+Kadd is discussed further with reference to FIG. 17 that shows a perspective view of the housing body KT1 with the ear pat 10 fit therein, for a left-ear speaker section 11L of the modification.

In FIG. 17, the ear pat 10 is fit into the housing body KT1 while the inner wall 10*c*1 of the ear pat 10 is engaged with the cladding section 19*n* of the housing body KT1 at the maximum engaging depth of K1=K+Kadd, or at a maximum engaging degree of K1, grater than an engaging depth or degree of K at the other engaging sections. The maximum engaging depth or degree of K1 makes the ear pat 10 not easily detached from the housing body KT1 against an external force applied, for example, in a direction depicted by an arrow D5, although the protruding member 10*c* of the ear pat 10 is made as flexible with the inner space S so that it is easily deformed.

The cladding section 19*n* of the housing body KT1 may not be limited to that shown in FIGS. 15 to 17, as long as the engaging depth of K1 at the protruding member 10*c* of the ear pat 10 is grater than the engaging depth of K at the other engaging sections between the ear pad 10 and the housing body KT1, such as, at an engaging section of the arc-like member 10*b*.

Figure 18:
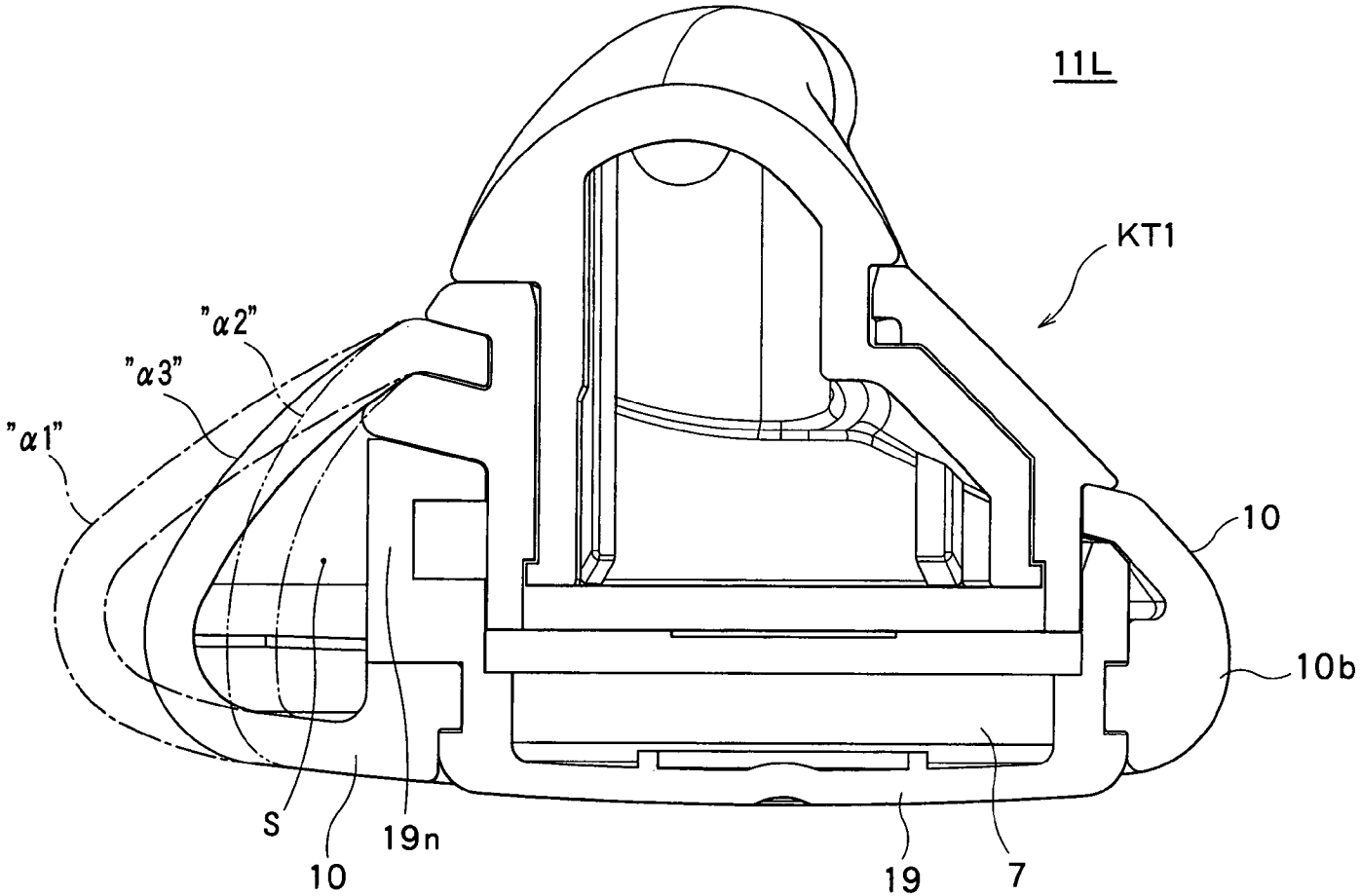
FIG. 18 shows a view illustrating several modifications to an ear pad for the headphone set according to the present invention.

FIG. 18 shows three options for the ear pad 10 to be detachable, in relation to FIG. 17, illustrating variation in the degree of protrusion for the protruding member 10*c* of the ear pat 10, for the left-ear speaker section 11L of the modification.

The three options shown in FIG. 18 are: an option $\alpha$1, depicted by a chain line, with the maximum degree of protrusion; an option $\alpha$2, depicted by a broken line, with the minimum degree of protrusion; and an option $\alpha$3, depicted by a solid line, with the intermediate degree of protrusion.

The options $\alpha$1, $\alpha$2 and $\alpha$3 are appropriate for users with larger, smaller, and medium sizes of the auricles, respectively, when used for the left-ear speaker section 11L of the headphone set 51.

The description made above for the left-ear speaker section 1L (11L) is also applied to the right-ear speaker section 1R (11R).

Therefore, the following are several advantages of the headphone set 50 (51), according to the description made above, with respect to the left- and right-ear speaker sections 1L and 1R (11L and 11R).

The protruding member 10*c* of the ear pad 10 is made of a flexible material and formed as having the inner space S for the left- and right-ear speaker sections 1L and 1R (11L and 11R). Thus, when the ear pad 10 is attached to the auricle E of user's left and right ears, the protruding member 10*c* touches the inner wall E3 and is deformed inwardly in accordance with the shape of the inner wall E3, creating a repulsion force "f" to press the inner wall E3, which force gives a reaction force "fr" to the arc-like member 10*b* to press the inner wall of the tragus E2, as discussed with reference to FIG. 12.

Therefore, the left- and right-ear speaker sections 1L and 1R (11L and 11R) are comfortably and firmly held in the auricle E of user's left and right ears, without respect to the shape of size of user's auricles.

Moreover, as described above, the housing body KT1, with the engaging depth of K1 at the protruding member 10*c* deeper than the engaging depth of K at the other engaging sections, such as, at the engaging section of the arc-like member 10*b*, allows the ear pad 10 to be detachable but not easily detached in a normal use.

In FIG. 17, the engaging depth of K1 is achieved with a larger contact zone in which the protruding section 10*d*1 of the ear pad 10 and the concave section 19*b*1 of the housing body KT1 touch or contact with each other at the busing 8 side (the opposite of the sound emitting surface 9*k*1). Such a larger contact zone may also be provided at the sound emitting surface 9*k*1 side.

It is understood by those skilled in the art that the forgoing description is a preferred embodiment of the present invention and that various changes and modifications may be made in the invention without departing from the sprit and scope thereof.

For example, in the embodiment and modification, the ear pad 10 has a structure of protrusion whereas the unit covers 9 and 19 have a structure of concavity so that the ear pad 10 is fit into the unit cover 9 or 19.

Not only that, in the present invention, the ear pad 10 may have a structure of concavity whereas the unit covers 9 and 19 may have a structure of protrusion so that the unit cover 9 or 19 is fit into the ear pad 10.

Moreover, in the embodiment and modification, the housing bodies KT and KT1 are assembled with the bushing 8, the housing 6, and the unit covers 9 (embodiment) and 19 (modification), respectively, with the speaker unit 9 installed therein.

Nevertheless, in the present invention, the housing bodies KT and KT1 may be any type of housing body that at least contains the speaker unit 9.

Furthermore, in the embodiment and modification, the housing bodies KT and KT1 are made by molding with resin, such as, ABS resin. Any material may, however, be used for the housing bodies KT and KT1 as long as it has stiffness to hold the speaker unit 7. The ear pad 10 may also be made of any material but more flexible than that for the housing bodies KT and KT1.

The sound emitting surface 9*k*1 of the unit cover 9 is an almost flat surface, which does not necessary mean a complete flat surface. Shown in FIG. 3 is the sound emitting surface 9*k*1 with a gentle curve sticking out outwardly from the unit cover 9.

For such an outwardly-curved sound emitting surface 9*k*1, the plane PL1, shown in (d) of FIG. 2, can be defined as a plane including, for example, the circumference of the outwardly-curved surface 9*k*1 or a plane including the top of the curved surface and perpendicular to the drive axis SPZ.

As disclosed above in detail, the present invention provides a headphone set that is comfortably attached to user's ears without easily detached in a normal use.

What is claimed is:

1. A headphone set comprising at least one speaker section, the speaker section including:

a speaker unit;

a housing to contain the speaker unit, the housing having a sound emitting surface through which sounds given off by the speaker unit are emitted out; and a circular member provided on an outer surface of the housing so that the sound emitting surface is surrounded by the circular member, the circular member being made of a material that is more flexible than a material of which the housing is made, wherein the circular member includes:

a protruding member that sticks out outwardly in a first radial direction of the circular member, the protruding member having a first top section, an opposing first bottom section, and an inner space interposed between the first top and bottom sections, the first top section being positioned farther than the first bottom section from the sound emitting surface; and an arc-like member that sticks out outwardly in a second radial direction of the circular member, the first and second radial directions being opposite to each other, a degree of sticking out for the arc-like member being smaller than a degree of sticking out for the protruding member, the arc-like member having a second top section and an opposing second bottom section in which the second top section is positioned farther than the second bottom section from the sound emitting surface, wherein the first top section of the protruding member is positioned farther than the second top section of the arc-like member from the sound emitting surface, and wherein the circular member has a first opening with a first center axis and an opposing second opening with a second center axis and positioned closer than the first opening to the sound emitting surface, the second center axis not coinciding with the first center axis, wherein the protruding and arc-like members are provided so that the first and second openings are interposed between the protruding and arc-like members.

2. The headphone set according to claim 1, wherein the circular member has an egg-like truncated-cone shaped surface when viewed from the sound emitting surface.

3. The headphone set according to claim 1, wherein the housing is exposed to an outside of the housing through the first opening whereas the sound emitting surface is exposed to the outside through the second opening.

4. A headphone set comprising at least one speaker section, the speaker section including:

a speaker unit;

a housing to contain the speaker unit, the housing having a sound emitting surface through which sounds given off by the speaker unit are emitted out; and a circular member provided on an outer surface of the housing so that the sound emitting surface is surrounded by the circular member, the circular member being made of a material that is more flexible than a material of which the housing is made, wherein the circular member includes:

a protruding member that sticks out outwardly in a first radial direction of the circular member, the protruding member having a first top section, an opposing first bottom section, and an inner space interposed between the first top and bottom sections, the first top section being positioned farther than the first bottom section from the sound emitting surface; and an arc-like member that sticks out outwardly in a second radial direction of the circular member, the first and second radial directions being opposite to each other, a degree of sticking out for the arc-like member being smaller than a degree of sticking out for the protruding member, the arc-like member having a second top section and an opposing second bottom section in which the second top section is positioned farther than the second bottom section from the sound emitting surface, wherein the first top section of the protruding member is positioned farther than the second top section of the arc-like member from the sound emitting surface, wherein the circular member has a first opening and an opposing second opening positioned closer than the first opening to the sound emitting surface, wherein the protruding and arc-like members are provided so that the first and second openings are interposed between the protruding and arc-like members, and wherein the housing has at least one through hole that is connected to the first opening so that an inside of the housing is exposed to the outside through the through hole and the first opening, whereas the sound emitting surface is exposed to the outside through the second opening.

5. The headphone set according to claim 4, wherein the speaker unit has a cord connected thereto and a bushing through which the cord is guided to an outside of the housing in a specific direction, the bushing having a cord protector lying in the specific direction for protecting the cord, the specific direction having a specific angle with a straight line that connects a center of the second opening and a protruding summit of the protruding member in a plane that includes the protruding summit and the center when viewed from the sound emitting surface, the specific angle being smaller than 90 degrees.

6. The headphone set according to claim 4, wherein the circular member is made of silicon rubber.

7. A headphone set comprising at least one speaker section, the speaker section including:

a speaker unit;

a housing to contain the speaker unit, the housing having a sound emitting surface through which sounds given off by the speaker unit are emitted out; and a circular member provided on an outer surface of the housing so that the sound emitting surface is surrounded by the circular member, wherein the housing has a circular concave section formed on the outer surface of the housing, and the circular member includes:

a protruding member that sticks out outwardly in a first radial direction of the circular member, the protruding member having a first top section, an opposing first bottom section, and an inner space interposed between the first top and bottom sections, the first bottom section being positioned closer than the first top section to the sound emitting surface;

an arc-like member that sticks out outwardly in a second radial direction of the circular member, the first and second radial directions being opposite to each other, a degree of sticking out for the arc-like member being smaller than a degree of sticking out for the protruding member, the arc-like member having a second top section and an opposing second bottom section positioned closer than the second top section to the sound emitting surface;

a first opening and an opposing second opening positioned closer than the first opening to the sound emitting surface, wherein the protruding and arc-like members are provided so that the first and second openings are interposed between the protruding and arc-like members, the housing being exposed to an outside of the housing through the first opening, the sound emitting surface being exposed to the outside through the second opening; and a circumferential protruding section provided at a circumference of the second opening, the circumferential protruding section sticking out from the circumference towards a center of the second opening, the circumferential protruding section being engaged with the circular concave section at a first engaging length in the protruding member side and a second engaging length in the arc-like member side, the first engaging length being longer than the second engaging length.

* * * * *